US007571542B2

(12) United States Patent
Nishino et al.

(10) Patent No.: US 7,571,542 B2
(45) Date of Patent: Aug. 11, 2009

(54) ALUMINUM SHEET EMBOSSING ROLL

(75) Inventors: Atsuo Nishino, Shizuoka (JP); Hirokazu Sawada, Shizuoka (JP); Akio Uesugi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 641 days.

(21) Appl. No.: 11/038,260

(22) Filed: Jan. 21, 2005

(65) Prior Publication Data

US 2005/0159281 A1 Jul. 21, 2005

(30) Foreign Application Priority Data

Jan. 20, 2004 (JP) ..... 2004-011616

(51) Int. Cl.
*B21K 1/02* (2006.01)
*B21K 27/02* (2006.01)

(52) U.S. Cl. ..... 29/895.3; 29/895; 29/895.31; 29/895.33; 492/1; 492/28; 492/30; 492/37; 72/252.5

(58) Field of Classification Search ..... 492/28, 492/30, 31, 33, 34, 35, 36, 37, 48, 1; 29/895, 29/895.3, 895.31, 895.33; 72/252.5
See application file for complete search history.

(56) References Cited

U.S. PATENT DOCUMENTS

| | | | | |
|---|---|---|---|---|
| 1,918,627 | A * | 7/1933 | Ballard | 204/212 |
| 4,803,032 | A * | 2/1989 | Schulz | 264/284 |
| 5,484,513 | A * | 1/1996 | Dejneko et al. | 205/681 |
| 5,773,087 | A | 6/1998 | Kashihara et al. | |
| 6,290,632 | B1 * | 9/2001 | Blake et al. | 492/54 |
| 6,324,978 | B1 * | 12/2001 | Kaulen et al. | 101/459 |
| 7,201,850 | B2 * | 4/2007 | Kawanishi et al. | 216/9 |
| 7,296,517 | B2 * | 11/2007 | Nishino et al. | 101/459 |
| 7,303,806 | B1 * | 12/2007 | Tatsuki et al. | 428/156 |
| 2002/0119394 | A1 | 8/2002 | Hultzsch et al. | |
| 2004/0048071 | A1 * | 3/2004 | Kosugi et al. | 428/412 |
| 2007/0137037 | A1 * | 6/2007 | Noble et al. | 29/895 |
| 2007/0137038 | A1 * | 6/2007 | Barr et al. | 29/895 |

FOREIGN PATENT DOCUMENTS

| | | |
|---|---|---|
| GB | 1327873 | 8/1973 |
| JP | 60-36196 A | 2/1985 |

(Continued)

OTHER PUBLICATIONS

English translation of JP 64-008293.*

(Continued)

*Primary Examiner*—Essama Omgba
(74) *Attorney, Agent, or Firm*—Sughrue Mion, PLLC

(57) ABSTRACT

A method of forming a roll for embossing aluminum sheet, and the associated roll, the method comprising subjecting a surface of a steel roll to at least the steps of, in order: blasting treatment, electrolytic treatment with 1,000 to 20,000 C/dm$^2$ of electricity in which the steel roll is used as the anode, and chromium plating treatment. An aluminum sheet embossing roll produced by the method of the present invention has on the surface thereof peaks, or asperities, which are of uniform height and very numerous. As a result, aluminum sheets obtained using such a roll, when employed as lithographic printing plate supports, have excellent printing characteristics, particularly a long press life and a high sensitivity.

4 Claims, 5 Drawing Sheets

FOREIGN PATENT DOCUMENTS

| | | | | |
|---|---|---|---|---|
| JP | 61-180249 | A | | 8/1986 |
| JP | 61-185767 | A | | 8/1986 |
| JP | 61-201800 | A | | 9/1986 |
| JP | 61-202707 | A | | 9/1986 |
| JP | 62-25094 | A | | 2/1987 |
| JP | 62-111792 | A | | 5/1987 |
| JP | 62-218189 | A | | 9/1987 |
| JP | 63-049310 | A | | 3/1988 |
| JP | 63168206 | A | * | 7/1988 |
| JP | 64-8293 | A | | 1/1989 |
| JP | 01-112079 | A | | 4/1989 |
| JP | 1-123094 | A | | 5/1989 |
| JP | 01202303 | A | * | 8/1989 |
| JP | 1-258806 | A | | 10/1989 |
| JP | 01262006 | A | * | 10/1989 |
| JP | 2-108403 | A | | 4/1990 |
| JP | 05-069014 | A | | 3/1993 |
| JP | 05-074341 | A | | 3/1993 |
| JP | 5-220503 | A | | 8/1993 |
| JP | 10315325 | A | * | 12/1998 |
| JP | 2000-211261 | A | | 8/2000 |
| JP | 2001-240994 | A | | 9/2001 |
| JP | 2002-201482 | A | | 7/2002 |
| JP | 2002361738 | A | * | 12/2002 |

OTHER PUBLICATIONS

European Search Report dated Aug. 8, 2008 issued in EP Application No. 05 00 1006.

* cited by examiner

ALUMINUM SHEET EMBOSSING ROLL

The entire contents of literatures cited in this specification are incorporated by reference.

BACKGROUND OF THE INVENTION

The present invention relates to an aluminum sheet embossing roll used for embossing the surface of an aluminum sheet and thereby imparting recessed portions and protruded portions. The present invention also relates to a method of manufacturing lithographic printing plate supports using such a roll.

One known method of manufacturing aluminum supports for printing plates used in lithographic printing (which are referred to hereinafter as "lithographic printing plate supports") involves using a steel roll that has been imparted with the recessed portions and the protruded portions on the surface by shot-blasting to roll an aluminum sheet and thereby impart recessed portions and protruded portions to the surface of the sheet (JP 60-36196 A (the term "JP XX-XXXXXX A" as used herein means an "unexamined published Japanese patent application")). Other known methods include the process described in JP 62-25094 A in which rolling is carried out at a rolling reduction of 2 to 20% using a steel roll fabricated by honing (which has an Ra of 0.5 to 1.5 μm and at least 0.6 μm deep of 500/mm2 or more recessed portions and protruded portions), the process described in JP 62-111792 A in which rolling is carried out at a rolling reduction of 2 to 20% using a roll chemically etched or honed to an Ra of 0.5 to 1.5 μm and to a number of recessed portions and protruded portions at least 0.6 μm deep of 500/mm2 or more, and the process described in JP 62-218189 A in which rolling is carried out at a rolling reduction of 2 to 20% using a roll textured to form recessed portions and protruded portions by electrodischarge machining to an average surface roughness Ra of 0.7 to 1.7 μm and a number of recessed portions and protruded portions at least 0.6 μm deep of 500/mm2 or more.

In rolls used for such a metal rolling operation, it is known that when the positions of peaks (protruded portions) on the surface of the roll having the recessed portions and protruded portions (such peak positions are also referred to below as the "roll surface peak height") are uniform, this helps to increase the life of the roll.

However, because these prior-art rolls employed to roll aluminum sheet for use as lithographic printing plate supports are subjected to blasting such as air blasting or shot blasting in which an abrasive is fired at the surface to roughen it, the resulting peaks on the roll surface are of non-uniform height. Accordingly, it has been difficult to obtain rolls having sufficiently large recessed portions and protruded portions and surface peaks of a sufficiently uniform height, such as are desired for embossing aluminum sheets to be used as lithographic printing plate supports.

Moreover, when these prior-art rolls are employed to manufacture embossed aluminum sheets for use as lithographic printing plate supports, particularly in computer-to-plate applications (commonly abbreviated as "CTP," this refers to technology in which digitized image data is carried on a highly convergent beam of radiation such as laser light which is scanned over a presensitized plate to expose it, thus enabling the direct production of a lithographic printing plate without relying on the use of lith film), it is difficult to achieve supports having excellent printing characteristics, particularly press life (number of impressions) and sensitivity.

JP 64-8293 A describes a chromium-plated roll for use in such processes as rolling steel sheet. This roll is obtained by subjecting a dull-finished roll as the anode to electrolytic treatment in an electrolyte solution so as to increase the peaks per inch (PPI) on the roll surface by 1 to 50% relative to before electrolysis, then chromium plating the treated roll.

Also known to the art is a chromium-plated metal-rolling roll having a surface roughness $R_z$ which has been lowered by 5 to 20% relative to the initial roughness, either before or after chromium plating (JP 61-202707 A); a chromium-plated roll obtained by the use of, in an etching operation, a chromium plating solution composed of chromium trioxide and sulfuric acid to carry out chromium plating with the roll serving as the anode after the surface roughness $R_z$ of the roll has been lowered by 5 to 20% from the initial roughness (JP 61-201800 A); and a chromium-plated roll obtained by carrying out electrolytic treatment on a bright-finished roll as the anode in a chromium plating solution so as to increase the PPI on the roll surface 1.3 to 15 times relative to the initial value, then administering chromium plating treatment using the roll as the cathode and subsequently polishing the plated roll surface (JP 1-123094 A).

In addition, JP 2001-240994 A discloses a method of manufacturing a chromium-plated roll in which the roll substrate as the anode is subjected to electrolytic treatment in an electrolyte solution. Next, chromium plating is carried out in a chromium plating solution having an iron concentration of less than 5 g/dm$^3$ and using the roll substrate as the cathode by raising the current density from 0 to a level of 25 to 35 A/dm$^2$ over a period of 10 to 30 minutes, maintaining the current density at this level for 2 to 3 minutes, then lowering the current density and holding it at 20 to 30 A/dm$^2$.

In some of these rolls, prior to being chromium plated, the surface of the steel roll is etched by electrolysis to increase the adherence of the chromium plating layer. However, in rolls used for such purposes as rolling steel sheet, regardless of whether such rolls are very smooth rolls for obtaining bright steel sheet or suitably roughened rolls for obtaining dull steel sheet, the chromium-plated surface of the roll is intended for smoothly rolling and finishing cold-rolled steel sheet. The shape required at the surface of the finished product thus differs entirely from that in transfer rolls for embossing aluminum sheet.

Other techniques related to the metal-rolling roll, and the manufacturing method, manufacturing apparatus and plating apparatus for the metal-rolling roll includes techniques described in JP 7-180084 A (plating apparatus), JP 63-99166 A (the apparatus for polishing a roll to a mirror-like finish), JP 8-27594 A (the steel sheet production process and chromium-plated roll for rolling steel sheet), JP 5-65686 A (the method of manufacturing dull rolls for rolling metal), JP 2003-171799 A (the batch-type chromium plating method and apparatus), JP 3-47985 A (the chromium plating process), and JP 2002-47595 A (the chromium plating method and apparatus).

SUMMARY OF THE INVENTION

It is therefore one object of the present invention to provide an aluminum sheet embossing roll which is suitable for the production of lithographic printing plate supports having an excellent printing performance, especially a long press life and a high sensitivity, and which is particularly suitable for the production of lithographic printing plate supports for CTP applications. Another object of the present invention is to provide a method of manufacturing lithographic printing plate supports using such a roll.

The inventors have found that a roll having peaks of uniform height on the surface can be obtained by subjecting a steel roll to blasting treatment, then subjecting the roll to electrolytic treatment with a specific amount of electricity in which the roll serves as the anode. The inventors have also discovered that when an aluminum sheet onto which recessed portions and protruded portions have been transferred with such a roll is used to manufacture lithographic printing plate supports, there can be obtained lithographic printing plate supports having an excellent printing performance, and especially a long print life and high sensitivity.

Accordingly, the present invention provides the following aluminum sheet embossing rolls and the following method of manufacturing lithographic printing plate supports.

(1) A roll for embossing aluminum sheet, which is obtainable by subjecting a surface of a steel roll to at least the steps of, in order: blasting treatment, electrolytic treatment with 1,000 to 20,000 C/dm$^2$ of electricity in which the steel roll is used as the anode, and chromium plating treatment.

(2) The roll for embossing aluminum sheet of the item (1), wherein protruded portions that have formed on the surface of the roll as a result of the blasting treatment are mechanically polished after the blasting treatment but before the electrolytic treatment.

(3) The roll for embossing aluminum sheet of the item (1) or (2), wherein the roll prior to the blasting treatment has a surface that has been polished to a mirror finish.

(4) The roll for embossing aluminum sheet of any one of the items (1) to (3), wherein the roll prior to the electrolytic treatment has a mean surface roughness $R_a$ of 0.3 to 1.5 μm.

(5) The roll for embossing aluminum sheet of any one of the items (1) to (4), wherein the roll after the electrolytic treatment has a mean surface roughness $R_a$ of 0.5 to 2.0 μm and a mean spacing for profile irregularities Sm of 10 to 200 μm.

(6) A method of manufacturing supports for lithographic printing plates, which method includes a step for transferring recessed portions and protruded portions to a surface of an aluminum sheet with the roll for embossing aluminum sheet of any one of the items (1) to (5).

The aluminum sheet embossing roll according to the present invention has on the surface thereof peaks, or asperities, which are of uniform height and very numerous. As a result, aluminum sheets obtained using such a roll, when employed as lithographic printing plate supports, have excellent printing characteristics, particularly a long press life and a high sensitivity.

BRIEF DESCRIPTION OF THE DIAGRAMS

DESCRIPTION OF THE PREFERRED EMBODIMENTS

Figure 1:
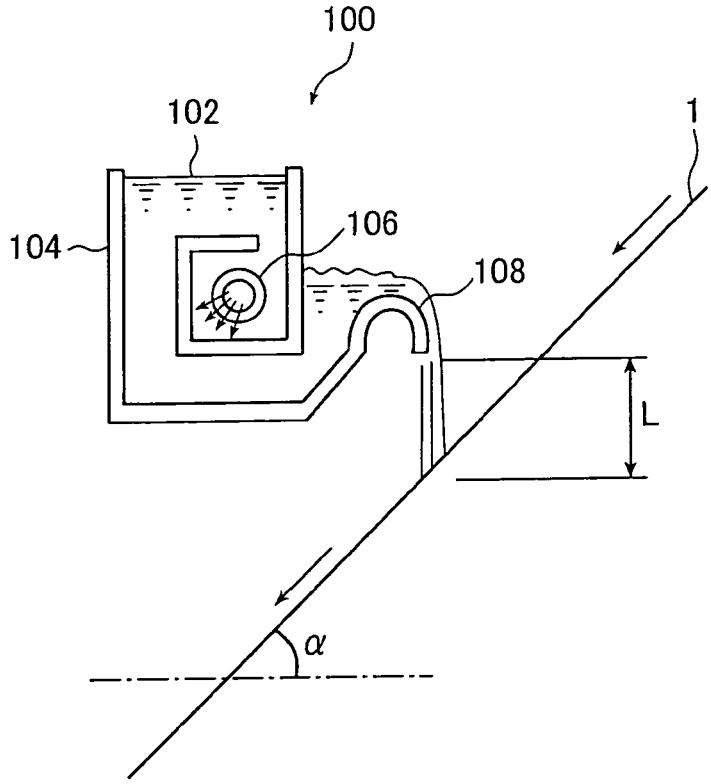
FIG. 1 is a schematic cross-sectional view of an apparatus which carries out rinsing with a free-falling curtain of water, such as may be used for rinsing in the inventive method of manufacturing a lithographic printing plate support.

The present invention is described below in conjunction with the attached diagrams.

Aluminum Sheet Embossing Roll

The aluminum sheet embossing roll of the present invention is obtainable by subjecting the surface of a steel roll to at least the steps of, in order: blasting treatment, electrolytic treatment with 1,000 to 20,000 C/dm$^2$ of electricity in which the steel roll is used as the anode, and chromium plating treatment.

Roll Material and Pretreatment

The roll used in the present invention is a steel roll. A roll made of forged steel is preferred. Illustrative examples of forged steels that may generally be used in rolls for rolling metal include tool steels (SKD), high-speed tool steels (SKH), high-carbon chromium-type bearing steels (SUJ), and forged steels containing carbon, chromium, molybdenum and vanadium as alloying elements. To achieve a long roll life, high-chromium alloy cast iron containing about 10 to 20 wt % chromium may be used.

It is preferable for the roll used in the present invention to be subjected to hardening treatment such as quenching or radical nitriding prior to blasting treatment. For good wear resistance, it is advantageous that the roll surface have a hardness Hv of 700 to 1,000 prior to blasting treatment It is also preferable for the roll used in this invention to be polished to a mirror-like finish beforehand. Examples of such mirror-like finishing include polishing with a grindstone, buffing and electrolytic polishing. Of these, buffing is especially preferred.

The roll for metal rolling is generally first polished with a grindstone or the like to confer it with a roundness and parallelness within desired ranges, but microscopic streak-like irregularities are observable on the resulting surface. Such irregularities can be eliminated by mirror-like finishing, enabling the peaks on the surface of the roll following the subsequently described blast treatment and electrolytic treatment to be of uniform height.

Blasting Treatment

In the practice of the present invention, the above-described roll is subjected to blasting treatment. Wet or dry blasting may be used without particular limitation, although dry blasting is preferred. Illustrative examples of dry blasting include air blasting and shot blasting. Of these, air blasting is preferred.

Any suitable grit, such as silica sand, steel shot or alumina particles, may be used in blasting treatment. Of these, alumina particles are preferred. Air blasting carried out with alumina particles is especially preferred.

When alumina particles, which are hard and angular, are used as the grit, a deep and uniform pattern of recessed and protruded portions can easily be formed on the surface of the transfer roll.

It is desirable for the alumina particles to have an average particle size of 10 to 300 μm, preferably 30 to 200 μm, and more preferably 50 to 150 μm. A particle size within this range enables a transfer roll of sufficiently large surface roughness to be obtained. Aluminum sheets to which pattern of recessed and protruded portions is imparted using this transfer roll will in turn have a sufficiently large surface roughness and a sufficiently high number of recessed portions.

When air blasting is used, it is preferable to carry out two blasts. In this way, uneven peaks among the surface recessed portions and protruded portions formed by the first blast can be removed by the second blast. Locally deep recessed portions will be less likely to form on the surface of aluminum sheets provided with the recessed and protruded portions using the roll thus obtained. The result is a better developability (sensitivity) when the lithographic printing plate support is rendered into a presensitized plate.

After blasting treatment, but before the subsequently described electrolytic treatment, it is desirable to mechanically polish asperities that have been formed by blasting. Suitable methods for doing so include polishing with sandpaper, a grindstone or a buff. The average surface roughness $R_a$ of the roll is lowered in this way by preferably 10 to 40% relative to the surface roughness after blasting treatment.

Mechanical polishing enables the peaks on the surface of the roll to be made of a uniform height so that locally deep areas do not form on the surface of aluminum sheets provided with the recessed and protruded portions by the roll. The result is a better developability (sensitivity) when the lithographic printing plate support is rendered into a presensitized plate.

The roll prior to the electrolytic treatment described below has an average surface roughness $R_a$ of preferably 0.3 to 1.5 μm, and more preferably 0.4 to 0.8 μm. At an average surface roughness $R_a$ of more than 0.3 μm, recessed portions and protruded portions that are sufficiently large can be transferred to the aluminum sheet, giving the lithographic printing plate ultimately obtained an excellent shininess property (here and below, "shininess property" refers to the ease with which the amount of dampening water on the plate surface can be perceived during printing). At an average surface roughness $R_a$ of 1.5 μm or less, peaks on the surface of the roll following electrolytic treatment can easily be made of uniform height, extending the life of the roll. Moreover, locally deep recessed portions do not readily form on the aluminum sheets when surface pattern of recessed and protruded portions is transferred thereto by the roll.

In addition, it is preferable for the roll surface prior to electrolytic treatment to have a maximum height $R_y$ of 1 to 15 μm.

Electrolytic Treatment

After blasting, the roll may be additionally polished if desired, after which it is electrolytically treated. Electrolytic treatment is administered with the roll serving as the anode and using 1,000 to 20,000 C/dm$^2$ of electricity. In this operation, the current concentrates at protruded portions areas among the surface pattern of recessed and protruded portions formed in blasting treatment. Dissolution of the protruded portions thus occurs preferentially, making the peaks on the electrolytically treated roll surface of uniform height.

The aluminum sheet embossing roll of the present invention has a long life on account of the uniform peak heights of its surface. Moreover, given that the roll surface peak heights are uniform, aluminum sheets to which surface pattern of recessed and protruded portions has been transferred from the roll bear recessed portions of uniform depth. Because locally deep recessed portions do not form, these aluminum sheets are able to provide presensitized plates of high sensitivity. This advantage is particularly evident in presensitized plates for CTP applications.

Electrolytic treatment is carried out by immersing the roll in an electrolyte solution.

The electrolyte solution is not subject to any particular limitation. Use can be made of aqueous solutions of acids that are generally employed in the graining treatment of metal, such as nitric acid, hydrochloric acid, sulfuric acid, chromic acid, and mixtures thereof.

Of these, the use of an anode electrolyzing bath similar to the subsequently described chromium plating bath is preferred. The so-called Sargent bath described later in the specification, which is commonly used as a hard chromium plating bath, is especially preferred.

The electrolytic treatment conditions are preferably as follows.

Electrolyte solution: chromic acid, 150 to 400 g/L, and preferably 250 to 350 g/L; sulfuric acid, 1 to 5 g/L, and preferably 2 to 4 g/L; iron, up to 7 g/L, and preferably 0.01 to 5 g/L Solution temperature: 20 to 70° C., and preferably 40 to 60° C.

Power supply waveform: DC or AC, preferably DC, and most preferably DC having 5% or less ripple Current density: 20 to 80 A/dm$^2$, and preferably 25 to 60 A/dm$^2$ Amount of electricity: 1,000 to 20,000 C/dm$^2$, preferably 2,000 to 10,000 C/dm$^2$, and most preferably 3,000 to 9,000 C/dm$^2$ When the amount of electricity is 1,000 C/dm$^2$ or more, sufficient dissolution of asperities occurs during electrolytic treatment, rendering the peaks on the roll surface of uniform height.

An amount of electricity not higher than 20,000 C/dm$^2$ is desirable to discourage the concentration of pits that form during electrolytic treatment.

It is preferable for the roll following electrolytic treatment to have an average surface roughness $R_a$ of 0.5 to 2.0 μm and a mean spacing of profile irregularities Sm of 10 to 200 μm.

At an average surface roughness $R_a$ of at least 0.5 μm, sufficiently large recessed portions and protruded portions can be transferred to the aluminum sheet, giving the lithographic printing plate ultimately obtained an excellent shininess property. At an average surface roughness $R_a$ of not more than 2.0 μm, the peaks on the roll surface can easily be made of uniform height, enabling presensitized plates of high sensitivity to be obtained.

At a mean spacing of profile irregularities Sm of 10 μm or more, sufficiently large recessed portions and protruded portions can easily be imparted to the aluminum sheet. A mean spacing of profile irregularities Sm of up to 200 μm enables lithographic printing plate supports having an excellent press life to be achieved.

Following electrolytic treatment, the roll surface has a maximum height $R_y$ of preferably 5 to 25 μm, and more preferably 7 to 15 μm.

Following electrolytic treatment, the roll has a surface with an average slope Δa of preferably 5 to 25°, and more preferably 8 to 20°.

The $R_a$, $R_y$, $S_m$ and Δa values can be measured in accordance with ISO 4287. Two-dimensional roughness measurements are carried out using a stylus-type roughness tester (e.g., Surfcom 575 manufactured by Tokyo Seimitsu Co., Ltd.). The average surface roughness $R_a$ as defined by ISO 4287 is measured five times, and the mean of the five measurements is used. The maximum height $R_y$ ($R_{max}$) within a sample length, the mean spacing of profile irregularities Sm (average value within a sample length), and the average slope Δa can be similarly measured.

Chromium Plating Treatment

Following electrolytic treatment, chromium plating is performed.

Chromium trioxide is used as the chromium plating bath. Specifically, use can be made of a bath in which a small amount of a catalyst, such as sulfuric acid, hydrofluoric acid or a silicofluoride, has been added. The use of a Sargent bath is preferred. A Sargent bath contains chromic trioxide and sulfuric acid, and is commonly used as a hard chromium plating bath.

Preferred chromium plating treatment conditions are as follows.

Plating bath composition: chromic acid, 150 to 400 g/L, and preferably 250 to 350 g/L; sulfuric acid, 1 to 5 g/L, and preferably 2 to 4 g/L; iron, up to 7 g/L, and preferably 0.01 to 5 g/L Solution temperature: 20 to 70° C., and preferably 40 to 60° C.

Power supply waveform: DC or AC, preferably DC, and most preferably DC having 5% or less ripple Current density: 20 to 80 A/dm$^2$, and preferably 25 to 60 A/dm$^2$ Amount of electricity: 1,000 to 20,000 C/dm$^2$, preferably 2,000 to 10,000 C/dm$^2$, and most preferably 3,000 to 9,000 C/dm$^2$ The anode is exemplified by an insoluble anode made of a lead alloy.

It is preferable to gradually raise the current from a low current density to a high current density over a period of 1 to 1,000 seconds, then maintain the current at a fixed value. This makes it easy to carry out uniform plating.

If baths of the same composition are used in electrolytic treatment and chromium plating treatment, then chromium plating can be carried out in the bath used for electrolytic treatment, simplifying the production process.

Alternatively, separate baths may be used for electrolytic treatment and chromium plating. This enables good chromium plating to be achieved because it eliminates the effect of the iron that dissolves into the electrolyte solution during electrolytic treatment in which the roll is used as the anode. When separate baths are used in this way, the roll travels through air between the baths, which lowers the activity at the surface of the roll and prevents good plating from being achieved. Hence, to activate the surface, it is desirable to carry out reverse electrolysis (etching treatment) at a current density of 20 to 80 A/dm$^2$ for 10 to 60 seconds just prior to chromium plating treatment.

The chromium plating thickness is preferably from 1 to 15 μm, and more preferably from 5 to 10 μm. A thickness of at least 1 μm provides a sufficient wear resistance, while a thickness of up to 15 μm does not smoothen the roll surface, enabling the pattern of recessed and protruded portions formed by blasting treatment and electrolytic treatment to be retained.

Following chromium plating treatment, the roll has an average surface roughness $R_a$ of preferably 0.5 to 2.0 μm and a mean spacing of profile irregularities Sm of preferably 10 to 200 μm.

An average surface roughness $R_a$ of at least 0.5 μm enables the transfer of sufficiently large recessed portions and protruded portions to the aluminum sheet, resulting in a lithographic printing plate of excellent shininess property (ease with which the amount of dampening water on the plate surface can be perceived during printing). An average surface roughness $R_a$ of up to 2.0 μm readily enables the peaks on the roll surface to be of a uniform height, giving a presensitized plate of high sensitivity.

Moreover, a mean spacing of profile irregularities Sm of at least 10 μm makes it easy to impart recessed portions and protruded portions of a sufficient size to the aluminum sheet, while a mean spacing of profile irregularities Sm of up to 200 μm imparts the printing plate with an excellent press life.

Following chromium plating treatment, the surface of the roll has a maximum height $R_y$ of preferably 5 to 25 μm, and more preferably 7 to 15 μm, and has an average slope Δa of preferably 5 to 25°, and more preferably 8 to 20°.

The surface characteristics $R_a$, $R_y$, $S_m$ and Δa can be measured by the methods described above.

It is desirable that, following chromium plating treatment, protruded portions on the roll surface are uniformly dispersed. The density of the protruded portions is preferably 10 to 1,000, and more preferably 50 to 500, per 400 μm square region.

Following chromium plating treatment, the surface of the roll has a hardness Hv of preferably 800 to 1,200.

Preferred Use of the Roll

The aluminum sheet embossing roll of the present invention can be used for embossing any type of metal, although it is suitable for embossing aluminum sheet, preferably aluminum sheet used as a lithographic printing plate support, and most preferably aluminum sheet used as a lithographic printing plate support for CTP applications. Lithographic Printing Plate Support Aluminum Sheet (Rolled Aluminum):

The aluminum sheet used in the inventive method of manufacturing a lithographic printing plate support is made of a dimensionally stable metal composed primarily of aluminum; that is, aluminum or aluminum alloy. Aside from sheets of pure aluminum, use can also be made of alloy sheets composed primarily of aluminum and small amounts of other elements, or plastic film or paper onto which aluminum or aluminum alloy has been laminated or vapor deposited. Use can also be made of a composite sheet obtained by bonding an aluminum sheet onto a polyethylene terephthalate film as described in JP 48-18327 B (the term "JP XX-XXXXXX B" as used herein means an "examined Japanese patent publication").

"Aluminum sheet," as used herein, refers generally to the above-mentioned supports composed of aluminum or aluminum alloy and the above-mentioned supports having a layer made of aluminum or aluminum alloy. Other elements which may be present in the aluminum alloy include silicon, iron, manganese, copper, magnesium, chromium, zinc, bismuth, nickel and titanium. The content of other elements in the alloy is not more than 10 wt %.

In the practice of the present invention, the use of a pure aluminum sheet is preferred. However, because completely pure aluminum is difficult to manufacture for reasons having to do with refining technology, the presence of a small amount of other elements is acceptable. Aluminum sheets that are suitable for use in the present invention are not specified here as to composition, but include materials that are known and used in the art, such as aluminum alloy sheets bearing the designations JIS A1050, JIS A1100, JIS A3005 and International Alloy Designation 3103A.

The aluminum sheet used in the present invention has a thickness of about 0.1 to 0.6 mm, preferably 0.15 to 0.4 mm, and most preferably 0.2 to 0.3 mm. This thickness can be changed as appropriate based on such considerations as the size of the printing press, the size of the printing plate and the desires of the user.

The aluminum alloy may be rendered into sheet stock by a method such as the following, for example. First, an aluminum alloy melt that has been adjusted to a given alloying ingredient content is subjected to cleaning treatment by an ordinary method, then is cast. Cleaning treatment, which is carried out to remove hydrogen and other unnecessary gases from the melt, typically involves flux treatment; degassing treatment using argon gas, chlorine gas or the like; filtering treatment using, for example, what is referred to as a rigid media filter (e.g., ceramic tube filters, ceramic foam filters), a filter that employs a filter medium such as alumina flakes or alumina balls, or a glass cloth filter; or a combination of degassing treatment and filtering treatment.

Cleaning treatment is preferably carried out to prevent defects due to foreign matter such as nonmetallic inclusions and oxides in the melt, and defects due to dissolved gases in the melt. The filtration of melts is described in, for example, JP 6-57432 A, JP 3-162530 A, JP 5-140659 A, JP 4-231425 A, JP 4-276031 A, JP 5-311261 A, and JP 6-136466 A. The degassing of melts is described in, for example, JP 5-51659 A and JP 5-49148 A. The present applicant discloses related art concerning the degassing of melts in JP 7-40017 A.

Next, the melt that has been subjected to cleaning treatment as described above is cast. Casting processes include those which use a stationary mold, such as direct chill casting, and those which use a moving mold, such as continuous casting.

In direct chill casting, the melt is solidified at a cooling speed of 0.5 to 30° C. per second. At less than 0.5° C., many coarse intermetallic compounds may form. When direct chill casting is carried out, an ingot having a thickness of 300 to 800 mm can be obtained. If necessary, this ingot is scalped by a conventional method, generally removing 1 to 30 mm, and preferably 1 to 10 mm, of material from the surface. The ingot may also be optionally soaked, either before or after scalping. In cases where soaking is carried out, the ingot is heat treated at 450 to 620° C. for 1 to 48 hours to prevent the coarsening of intermetallic compounds. The effects of soaking treatment may be inadequate if heat treatment is shorter than one hour. If soaking treatment is not carried out, this can have the advantage of lowering costs.

The ingot is then hot-rolled and cold-rolled, giving a rolled aluminum sheet. A temperature of 350 to 500° C. at the start of hot rolling is appropriate. Intermediate annealing may be carried out before or after hot rolling, or even during hot rolling. The intermediate annealing conditions may consist of 2 to 20 hours of heating at 280 to 600° C., and preferably 2 to 10 hours of heating at 350 to 500° C., in a batch-type annealing furnace, or of heating for up to 6 minutes at 400 to 600° C., and preferably up to 2 minutes at 450 to 550° C., in a continuous annealing furnace. Using a continuous annealing furnace to heat the rolled sheet at a temperature rise rate of 10 to 200° C. enables a finer crystal structure to be achieved.

The aluminum sheet that has been finished by the above process to a given thickness of, say, 0.1 to 0.5 mm may then be flattened with a leveling machine such as a roller leveler or a tension leveler. Flattening may be carried out after the aluminum has been cut into discrete sheets. However, to enhance productivity, it is preferable to carry out such flattening with the rolled aluminum in the state of a continuous coil. The sheet may also be passed through a slitter line to cut it to a predetermined width. A thin film of oil may be provided on the aluminum sheet to prevent scuffing due to rubbing between adjoining aluminum sheets. Suitable use may be made of either a volatile or non-volatile oil film, as needed.

Continuous casting processes that are industrially carried out include processes which use cooling rolls, such as the twin roll process (Hunter process) and the 3C process, the twin belt process (Hazelett process), and processes which use a cooling belt, such as the Alusuisse Caster II mold, or a cooling block. When a continuous casting process is used, the melt is solidified at a cooling rate of 100 to 1,000° C./s. Continuous casting processes generally have a faster cooling rate than direct chill casting processes, and so are characterized by the ability to achieve a higher solid solubility by alloying ingredients in the aluminum matrix. Technology relating to continuous casting processes that has been disclosed by the present applicant is described in, for example, JP 3-79798 A, JP 5-201166 A, JP 5-156414 A, JP 6-262203 A, JP 6-122949 A, JP 6-210406 A and JP 6-26308 A.

When continuous casting is carried out, such as by a process involving the use of cooling rolls (e.g., the Hunter process), the melt can be directly and continuously cast as a plate having a thickness of 1 to 10 mm, thus making it possible to omit the hot rolling step. Moreover, when use is made of a process that employs a cooling belt (e.g., the Hazelett process), a plate having a thickness of 10 to 50 mm can be cast. Generally, by positioning a hot-rolling roll immediately after casting, the cast plate can then be successively rolled, enabling a continuously cast and rolled plate with a thickness of 1 to 10 mm to be obtained.

These continuously cast and rolled plates are then passed through such steps as cold rolling, intermediate annealing, flattening and slitting in the same way as described above for direct chill casting, and thereby finished to a sheet thickness of 0.1 to 0.5 mm. Technology disclosed by the present applicant concerning the intermediate annealing conditions and cold rolling conditions in a continuous casting process is described in, for example, JP 6-220593 A, JP 6-210308 A, JP 7-54111 A and JP 8-92709 A.

Preferably, the aluminum sheet used in the present invention has a JIS temper designation of H18.

It is desirable for the aluminum sheet manufactured as described above to have the following properties.

For the aluminum sheet to achieve the stiffness required of a lithographic printing plate support, it should have a 0.2% offset yield strength of preferably at least 120 MPa. To ensure some degree of stiffness even when burning treatment has been carried out, the 0.2% offset yield strength following 3 to 10 minutes of heat treatment at 270° C. should be at least 80 MPa, and preferably at least 100 MPa. In cases where the aluminum sheet is required to have a high stiffness, use may be made of an aluminum material containing magnesium or manganese. However, because a higher stiffness lowers the ease with which the plate can be fit onto the plate cylinder of the printing press, the plate material and the amounts of minor components added thereto are suitably selected according to the intended application. Related technology disclosed by the present applicant is described in, for example, JP 7-126820 A and JP 62-140894 A.

The aluminum sheet more preferably has a tensile strength of 160±15 N/mm$^2$, a 0.2% outset yield strength of 140±15 MPa, and an elongation as specified in JIS Z2241 and Z2201 of 1 to 10%.

Because the crystal structure at the surface of the aluminum sheet may give rise to a poor surface quality when chemical graining treatment or electrochemical graining treatment is carried out, it is preferable that the crystal structure not be too coarse. The crystal structure at the surface of the aluminum sheet has a width of preferably up to 200 μm, more preferably up to 100 μm, and most preferably up to 50 μm. Moreover, the crystal structure has a length of preferably up to 5,000 μm, more preferably up to 1,000 μm, and most preferably up to 500 μm. Related technology disclosed by the present applicant is described in, for example, JP 6-218495 A, JP 7-39906 A and JP 7-124609 A.

It is preferable for the alloying element distribution at the surface of the aluminum sheet to be reasonably uniform because non-uniform distribution of alloying ingredients at the surface of the aluminum sheet sometimes leads to a poor surface quality when chemical graining treatment or electrochemical graining treatment is carried out. Related technology disclosed by the present applicant is described in, for example, JP 6-48058 A, JP 5-301478 A and JP 7-132689 A.

In the inventive method of manufacturing a support for lithographic printing plates, recessed portions and protruded portions are formed on the surface of the above-described aluminum sheet by using the inventive aluminum embossing roll, such as in a final rolling step, to transfer surface pattern of recessed and protruded portions from the roll to the sheet.

An especially preferred way of doing this is to accompany cold rolling to the final sheet thickness, or finish cold rolling in which the surface state is finished after the sheet has been brought to its final thickness, with an operation in which the patterned surface of the roll is pressed against the aluminum sheet, transferring surface recessed portions and protruded portions to the aluminum sheet and thus forming a pattern of the recessed portions and protruded portions on the sheet surface. These methods are able to simplify the operation, which can significantly reduce costs. A specific example of such a method is described in JP 6-262203 A.

The rolling reduction in this cold rolling operation is preferably 0.5 to 20%, more preferably 1 to 8%, and most preferably 1 to 5%.

Rolling for the sake of transfer can be carried out in one to three passes.

The aluminum sheet on which a pattern of recessed portions and protruded portions has been formed by transfer to the surface has an average surface roughness $R_a$ of preferably 0.4 to 1.0 μm, a mean spacing of profile irregularities Sm of preferably 30 to 150 μm, a maximum height $R_y$ of preferably 1 to 10 μm, and an average slope Δa of preferably 1 to 10°.

Using an aluminum sheet onto the surface of which a pattern of recessed portions and protruded portions has been transferred increases scumming resistance because the average pitch and depth of the surface recessed portions and protruded portions is more uniform than in a pattern of recessed portions and protruded portions formed with a brush and abrasive.

In addition, the use of such an aluminum sheet facilitates control of the amount of dampening water (excellent shininess property) when the lithographic printing plate is on the printing press while also reducing the energy consumed in the subsequently described alkali etching treatment and electrolytic graining treatment. Also, in the first alkali etching treatment described later in this specification, the amount of material removed by etching can be reduced to about 10 g/m$^2$ or less, enabling costs to be reduced. Moreover, using an aluminum sheet onto the surface of which a pattern of recessed portions and protruded portions has been transferred as described above increases the surface area of the lithographic printing plate support obtained therefrom, resulting in a longer press life.

The recessed portions and protruded portions formed by transfer from the metal rolling roll are preferably formed on both sides of the aluminum sheet. In this way, the percent elongation on the front and back sides of the aluminum sheet can be adjusted so as to be about the same, enabling an aluminum sheet of excellent flatness to be achieved.

The aluminum sheet used in this invention is in the form of a continuous strip or discrete sheets. That is, it may be either an aluminum web or individual sheets cut to a size which corresponds to the presensitized plates that will be shipped as the final product.

Because scratches and other marks on the surface of the aluminum sheet may become defects when the sheet is fabricated into a lithographic printing plate support, it is essential to minimize the formation of such marks prior to the surface treatment operations for rendering the aluminum sheet into a lithographic printing plate support. It is thus desirable for the aluminum sheet to be stably packed in such a way that it will not be easily damaged during transport.

When the aluminum sheet is in the form of a web, it may be packed by, for example, laying hardboard and felt on an iron pallet, placing cardboard doughnuts on either side of the product, wrapping everything with polytubing, inserting a wooden doughnut into the opening at the center of the coil, stuffing felt around the periphery of the coil, tightening steel strapping about the entire package, and labeling the exterior. In addition, polyethylene film can be used as the outer wrapping material, and needled felt and hardboard can be used as the cushioning material. Various other forms of packing exist, any of which may be used so long as the aluminum sheet can be stably transported without being scratched or otherwise marked.

Surface Treatment of the Aluminum Sheet of Which the Pattern of Recessed and Protruded Portions is Transferred The aluminum sheet to which surface pattern of recessed and protruded portions has been transferred is then administered various surface treatment, such as alkali etching, desmutting, electrochemical graining, anodizing treatment, hydrophilizing treatment and sealing treatment, thereby forming a support for a lithographic printing plate.

That is, the present invention provides a method of manufacturing lithographic printing plates supports, which method includes a step in which pattern of recessed and protruded portions is transferred to a surface of an aluminum sheet with the above-described aluminum sheet embossing roll.

Preferred embodiments of the surface treatment process are given below.

Embodiment 1

A process in which the aluminum sheet is administered, in order, etching treatment in an aqueous alkali solution (also referred to below as "alkali etching treatment"), electrochemical graining treatment in an aqueous solution containing nitric acid (also referred to below as "nitric acid electrolysis"), alkali etching treatment, electrochemical graining treatment in an aqueous solution containing hydrochloric acid (also referred to below as "hydrochloric acid electrolysis"), alkali etching treatment, and anodizing treatment.

Embodiment 2

A process in which the aluminum sheet is administered, in order, alkali etching treatment, nitric acid electrolysis, alkali etching treatment, and anodizing treatment.

Embodiment 3

A process in which the aluminum sheet is administered, in order, alkali etching treatment, hydrochloric acid electrolysis, alkali etching treatment, and anodizing treatment.

Embodiment 4

A process in which the aluminum sheet is administered, in order, alkali etching treatment, hydrochloric acid electrolysis, alkali etching treatment, nitric acid electrolysis, alkali etching treatment, and anodizing treatment.

Embodiment 5

A process in which the aluminum sheet is administered, in order, alkali etching treatment, hydrochloric acid electrolysis, alkali etching treatment, hydrochloric acid electrolysis, alkali etching treatment, and anodizing treatment.

In these processes, it is desirable to follow alkali etching treatment with a desmutting step. Moreover, after anodizing treatment, it is preferable to carry out sealing treatment and/or hydrophilizing treatment; it is even more preferable to carry out sealing treatment, or sealing treatment followed by hydrophilizing treatment.

Additional preferred embodiments of the surface treatment process are described below.

Embodiment 6

A process in which the aluminum sheet is administered, in order, a first alkali etching treatment, a first desmutting treatment, nitric acid electrolysis or hydrochloric acid electrolysis (first electrolytic graining treatment), a second alkali etching treatment, a second desmutting treatment, hydrochloric acid electrolysis (second electrolytic graining treatment), a third alkali etching treatment, a third desmutting treatment and anodizing treatment; a process in which the above anodizing treatment is followed also by hydrophilizing treatment; a process in which the above hydrophilizing treatment is followed also by sealing treatment; a process in which mechanical graining treatment using a brush and abrasive is administered prior to the above first alkali etching treatment.

Various operations other than those mentioned above may also be included in the method of manufacturing a lithographic printing plate support according to the present invention.

The surface treatment steps are each described in detail below with reference to the processes exemplified in Embodiment 6

Mechanical Graining Treatment

In the inventive method of manufacturing lithographic printing plate supports, mechanical graining treatment with a brush and an abrasive can also be carried out on the above-described aluminum sheet onto the surface of which recessed portions and protruded portions have been transferred as described above.

By carrying out mechanical graining treatment with a brush and abrasive, if the aluminum sheet onto which surface recessed portions and protruded portions have been transferred has a small surface area, the surface area can be increased. This enhances water retention by the sheet.

Problems associated with prior-art mechanical graining treatment using a brush and abrasive have been the formation of angular features, a tendency for portions of the photosensitive layer to remain on the exposed and developed presensitized plate, and a tendency for scumming to arise due to ink catching at the edges of pits. These problems can be overcome by using a combination of both the transfer of surface pattern (embossing) and mechanical graining treatment using a brush and abrasive.

Because the amount of alkali etching can be reduced, this approach is also advantageous in terms of cost.

Brush graining, which is suitable for use as the mechanical graining treatment, is described.

Brush graining is generally carried out using a roller-type brush composed of a round cylinder on the surface of which are set numerous plastic bristles made of a material such as nylon (Trademark), propylene plastic or polyvinyl chloride to rub one or both sides of the aluminum sheet while spraying an abrasive-containing slurry onto the rotating brush. A polishing roller provided on the surface with a polishing layer can be used instead of the above-described roller-type brush and slurry.

When a roller-type brush is used, the bristles on the brush has a flexural modulus of preferably 10,000 to 40,000 kg/cm$^2$, and more preferably 15,000 to 35,000 kg/cm$^2$, and a stiffness of preferably up to 500 g, and more preferably up to 400 g. The brush diameter is generally 0.2 to 0.9 mm. The bristle length can be suitably selected according to the outside diameter of the roller brush and the cylinder diameter, but is generally from 10 to 100 mm.

It is advantageous to use a plurality of nylon brushes. At least three brushes is desirable, with four or more brushes being preferred. The waviness component of recessed portions formed on the surface of the aluminum sheet can be adjusted by changing the number of brushes.

The load on the driving motor which rotates the brush is preferably not less than 1 kW plus, more preferably not less than 2 kW plus, and most preferably not less than 8 kW plus, relative to the load before the brush roller is pressed against the aluminum sheet. The depth of the recessed portions formed on the surface of the aluminum sheet can be adjusted by varying this load. The brush rotates at a speed of preferably at least 100 rpm, and more preferably at least 200 rpm.

A known abrasive may be used. Illustrative examples include pumice stone, silica sand, aluminum hydroxide, alumina powder, silicon carbide, silicon nitride, volcanic ash, carborundum, emery, and mixtures thereof. Of these, pumice stone and silica sand are preferred. Because silica sand is harder than pumice stone and breaks less readily, it has an excellent graining efficiency. In cases where the formation of locally deep recessed portions is to be avoided, the use of aluminum hydroxide is desirable because grains of aluminum hydroxide fragment under the application of an excessive load.

To provide an excellent graining efficiency and narrow the pitch of the grained pattern, it is desirable for the abrasive to have a median diameter of preferably 2 to 100 μm, and more preferably 20 to 60 μm. The depth of recessed portions formed on the surface of the aluminum sheet can be adjusted by varying the median diameter of the abrasive.

The abrasive is typically suspended in water or the like, and used as a slurry. In addition to the abrasive, the slurry may also contain a thickener, a dispersant such as a surfactant, and a preservative. Preferably, the slurry has a specific gravity of 0.5 to 2.

An example of an apparatus suitable for mechanical graining treatment is that described in JP 50-40047 B.

One apparatus for carrying out mechanical graining treatment with a brush and an abrasive that may be used is described in JP 2002-211159 A by the present applicant.

In working the present invention, when mechanical graining treatment is administered by a brush and abrasive to an aluminum sheet on the surface of which a pattern of recessed portions and protruded portions has been formed by transfer, it is desirable for the increase in the average roughness $R_a$ to be not more than 0.3 μm, preferably not more than 0.2 μm, and more preferably not more than 0.1 μm.

First Alkali Etching Treatment

Alkali etching treatment is a treatment in which the surface layer of the above-described aluminum sheet is dissolved by bringing the aluminum sheet into contact with an alkali solution.

The purpose of the first alkali etching treatment carried out prior to the first electrolytic graining treatment is to enable the formation of uniform pits in the first electrolytic graining treatment and to remove substances such as rolling oils, contaminants and a natural oxide film from the surface of the aluminum sheet (rolled aluminum).

In the first alkali etching treatment, the amount of material removed by etching (also referred to below as the "etching amount") is preferably at least 0.1 $g/m^2$, more preferably at least 0.5 $g/m^2$, and even more preferably at least 1 $g/m^2$, but preferably not more than 10 $g/m^2$, more preferably not more than 8 $g/m^2$, and even more preferably not more than 5 $g/m^2$. By having the lower limit for the etching amount fall in the above range, uniform pits can be formed in the subsequent first electrolytic graining treatment and uneven treatment can be prevented from occurring. By having the upper limit in the etching amount fall in the above-indicated range, the amount of alkaline aqueous solution used decreases, which is economically desirable.

Alkalis that may be used in the alkali solution are exemplified by caustic alkalis and alkali metal salts. Specific examples of suitable caustic alkalis include sodium hydroxide and potassium hydroxide. Specific examples of suitable alkali metal salts include alkali metal silicates such as sodium metasilicate, sodium silicate, potassium metasilicate and potassium silicate; alkali metal carbonates such as sodium carbonate and potassium carbonate; alkali metal aluminates such as sodium aluminate and potassium aluminate; alkali metal aldonates such as sodium gluconate and potassium gluconate; and alkali metal hydrogenphosphates such as sodium hydrogenphosphate, potassium hydrogenphosphate, sodium dihydrogenphosphate and potassium dihydrogenphosphate. Of these, caustic alkali solutions and solutions containing both a caustic alkali and an alkali metal aluminate are preferred on account of the high etch rate and low cost. An aqueous solution of sodium hydroxide is especially preferred.

In the first alkali etching treatment, the alkali solution has a concentration of preferably at least 30 g/L, and more preferably at least 300 g/L, but preferably not more than 500 g/L, and more preferably not more than 450 g/L.

It is desirable for the alkali solution to contain aluminum ions. The aluminum ion concentration is preferably at least 1 g/L, and more preferably at least 50 g/L, but preferably not more than 200 g/L, and more preferably not more than 150 g/L. Such an alkali solution can be prepared from, for example, water, a 48 wt % solution of sodium hydroxide in water, and sodium aluminate.

In the first alkali etching treatment, the alkali solution temperature is preferably at least 30° C., and more preferably at least 50° C., but preferably not more than 80° C., and more preferably not more than 75° C.

The treatment time is preferably at least 1 second, and more preferably at least 2 seconds, but preferably not more than 30 seconds, and more preferably not more than 15 seconds.

When the aluminum sheet is continuously etched, the aluminum ion concentration in the alkali solution rises and the amount of material etched from the aluminum sheet changes. It is thus preferable to control the etching solution composition as follows.

First, a matrix of the electrical conductivity, specific gravity and temperature or a matrix of the conductivity, ultrasonic wave propagation velocity and temperature is prepared with respect to a matrix of the sodium hydroxide concentration and the aluminum ion concentration. The solution composition is then measured based on either the conductivity, specific gravity and temperature or the conductivity, ultrasonic wave propagation velocity and temperature, and sodium hydroxide and water are added up to control target values for the solution composition. Next, the etching solution which has increased in volume with the addition of sodium hydroxide and water is allowed to overflow from a circulation tank, thereby keeping the amount of solution constant. The sodium hydroxide added may be industrial grade 40 to 60 wt % sodium hydroxide.

The conductivity meter and hydrometer used to measure electrical conductivity and specific gravity are each preferably temperature-compensated instruments. The hydrometer is preferably a pressure differential hydrometer.

Illustrative examples of methods for bringing the aluminum sheet into contact with the alkali solution include a method in which the aluminum sheet is passed through a tank filled with an alkali solution, a method in which the aluminum sheet is immersed in a tank filled with an alkali solution, and a method in which the surface of the aluminum sheet is sprayed with an alkali solution.

The most desirable of these is a method that involves spraying the surface of the aluminum sheet with an alkali solution. A method in which the etching solution is sprayed onto the aluminum sheet at a rate of 10 to 100 L/min per spray line from preferably a plurality of spray lines bearing 2 to 5 mm diameter openings at a pitch of 10 to 50 mm is especially desirable.

Following the completion of alkali etching treatment, it is desirable to remove the etching solution from the aluminum sheet with nip rollers, subject the sheet to rinsing treatment with water for 1 to 10 seconds, then remove the water with nip rollers.

Rinsing treatment is preferably carried out by rinsing with a rinsing apparatus that uses a free-falling curtain of water and also by rinsing with spray lines.

FIG. 1 is a schematic cross-sectional view of an apparatus 100 which carries out rinsing with a free-falling curtain of water. As shown in FIG. 1, the apparatus 100 that carries out rinsing treatment with a free-falling curtain of water has a water holding tank 104 that holds water 102, a pipe 106 that feeds water to the water holding tank 104, and a flow distributor 108 that supplies a free-falling curtain of water from the water holding tank 104 to the aluminum sheet 1.

In this apparatus 100, the pipe 106 feeds water 102 to the water holding tank 104. When the water 102 overflows from the tank 104, it is distributed by the flow distributor 108 and the free-falling curtain of water is supplied to the aluminum sheet 1. A flow rate of 10 to 100 L/min is preferred when this apparatus 100 is used. The distance L over which the water 102 between the apparatus 100 and the aluminum sheet 1 exists as a free-falling curtain of liquid is preferably from 20 to 50 mm. Moreover, it is preferable for the aluminum sheet to be inclined at an angle $\alpha$ to the horizontal of 30 to 80°.

By using an apparatus like that in FIG. 1 which rinses the aluminum sheet with a free-falling curtain of water, the aluminum sheet can be uniformly rinsed. This in turn makes it possible to enhance the uniformity of treatment carried out prior to rinsing.

A preferred example of an apparatus that carries out rinsing treatment with a free-falling curtain of water is described in JP 2003-96584 A.

Alternatively, rinsing may be carried out with a spray line having a plurality of spray tips that emit fan-like sprays of water and are disposed along the width of the aluminum sheet. The interval between the spray tips is preferably 20 to 100 mm, and the amount of water discharged per spray tip is preferably 0.5 to 20 L/min. The use of a plurality of spray lines is preferred.

First Desmutting Treatment

After the first alkali etching treatment, it is preferable to carry out acid pickling (first desmutting treatment) to remove contaminants (smut) remaining on the surface of the aluminum sheet. Desmutting treatment is carried out by bringing an acidic solution into contact with the aluminum sheet.

Examples of acids that may be used include nitric acid, sulfuric acid, phosphoric acid, chromic acid, hydrofluoric acid and tetrafluoroboric acid.

In cases where nitric acid electrolysis is subsequently carried out as the first electrolytic graining treatment, it is preferable to use overflow from the electrolyte solution employed in nitric acid electrolysis to carry out the first desmutting treatment that follows the first alkali etching treatment.

As in the case of alkali etching treatment, the composition of the desmutting treatment solution can be controlled by selecting and using a method in which the electrical conductivity and temperature are controlled with respect to a matrix of the acidic solution concentration and the aluminum ion concentration, a method in which the electrical conductivity, specific gravity and temperature are instead controlled with respect to the above matrix, or a method in which the electrical conductivity, ultrasonic wave propagation velocity and temperature are instead controlled.

In the first desmutting treatment, it is preferable to use an acidic solution containing 1 to 400 g/L of acid and 0.1 to 5 g/L of aluminum ions.

The acidic solution has a temperature of preferably at least 20° C., and more preferably at least 30° C., but preferably not more than 70° C., and more preferably not more than 60° C.

In the first desmutting treatment, the treatment time is preferably at least 1 second, and more preferably at least 4 seconds, but preferably not more than 60 seconds, and more preferably not more than 40 seconds.

Illustrative examples of the method of bringing the aluminum sheet into contact with the acidic solution include passing the aluminum sheet through a tank filled with the acidic solution, immersing the aluminum sheet in a tank filled with the acidic solution, and spraying the acidic solution onto the surface of the aluminum sheet.

Of these, a method in which the acidic solution is sprayed onto the surface of the aluminum sheet is preferred. More specifically, a method in which an etching solution is sprayed from at least one spray line, and preferably two or more spray lines, each having 2 to 5 mm diameter openings spaced at a pitch of 10 to 50 mm, at a rate of 10 to 100 L/min per spray line is desirable.

After desmutting treatment, it is preferable to remove the solution with nip rollers, then to carry out rinsing treatment with water for 1 to 10 seconds and again remove the water with nip rollers.

Rinsing treatment is the same as rinsing treatment following alkali etching treatment. However, it is preferable for the amount of water used per spray line to be from 1 to 20 L/min.

If overflow from the electrolyte solution used in the subsequently carried out nitric acid electrolysis is employed as the desmutting solution in the first desmutting treatment, rather than having desmutting treatment followed by the removal of solution with nip rollers and rinsing treatment, it is preferable to handle the aluminum sheet up until the nitric acid electrolysis step by suitably spraying it with a desmutting solution as needed so that the surface of the aluminum sheet does not dry.

First Electrolytic Graining Treatment

The first electrolytic graining treatment is the electrochemical graining treatment in a nitric acid or hydrochloric acid-containing aqueous solution that is initially carried out.

By carrying out both a first electrolytic graining treatment and a second electrolytic graining treatment in the manner of above Embodiments 1, 4, 5 and 6, a grained pattern of overlapping and highly uniform pattern of recessed and protruded portions can be formed on the surface of the aluminum sheet, enabling excellent scumming resistance and a long press life to be achieved.

The average surface roughness of the aluminum sheet following the first electrolytic graining treatment is preferably 0.45 to 0.85 μm.

In above Embodiments 2 and 3, nitric acid electrolysis and hydrochloric acid electrolysis are each carried out. In Embodiment 4, nitric acid electrolysis is carried out after hydrochloric acid electrolysis, whereas in Embodiment 5, hydrochloric acid electrolysis is carried out twice. Nitric acid electrolysis and hydrochloric acid electrolysis are described below, primarily with reference to their use in Embodiments 1 and 6. However, in the other embodiments, the conditions for each may be varied according to the characteristics of the particular embodiment.

Electrochemical Graining Treatment in Nitric Acid-Containing Aqueous Solution

By carrying out electrochemical graining treatment in a nitric acid-containing aqueous solution (nitric acid electrolysis), a suitable pattern of recessed and protruded portions can be formed on the surface of the aluminum sheet. In the practice of the present invention, if the aluminum sheet has a relatively high copper content, relatively large and uniform pits are formed during nitric acid electrolysis. As a result, lithographic printing plates manufactured from the supports obtained according to the present invention have a long press life.

The nitric acid-containing aqueous solution may be one which is employed in ordinary electrochemical graining treatment using a direct current or an alternating current and which is prepared by adding at least one nitric acid ion-bearing nitrate compound (e.g., aluminum nitrate, sodium nitrate, ammonium nitrate) in a range of 1 g/L to saturation to an aqueous solution of nitric acid having a concentration of 1 to 100 g/L. The nitric acid-containing aqueous solution may have dissolved therein metals or the like which are present in the aluminum alloy, such as iron, copper, manganese, nickel, titanium, magnesium and silicon. Hypochlorous acid and hydrogen peroxide may be added in an amount of 1 to 100 g/L.

Specifically, a solution prepared by dissolving aluminum nitrate in an aqueous solution of nitric acid having a nitric acid concentration of 5 to 15 g/L to an aluminum ion concentration of 3 to 7 g/L is preferred.

Moreover, by adding and using a compound capable of forming a complex with copper, uniform graining treatment may be carried out even on an aluminum sheet having a high copper content. Compounds capable of forming a complex with copper include ammonia; amines which can be obtained by substituting the hydrogen atom on ammonia with a hydrocarbon (e.g., aliphatic, aromatic) group, such as methylamine, ethylamine, dimethylamine, diethylamine, trimethylamine, cyclohexylamine, triethanolamine, triisopropanolamine and ethylenediamine tetraacetate (EDTA); and metal carbonates such as sodium carbonate, potassium carbonate and potassium hydrogencarbonate. Additional compounds suitable for this purpose include ammonium salts such as ammonium nitrate, ammonium chloride, ammonium sulfate, ammonium phosphate and ammonium carbonate.

The temperature of the nitric acid-containing aqueous solution is preferably at least 30° C., but preferably not more than 55° C.

Pits having an average diameter of 1 to 10 μm can be formed by nitric acid electrolysis. However, when the amount of electricity is made relatively large, the electrolytic reaction becomes concentrated, resulting in the formation of honeycombed pits larger than 10 μm.

To obtain such a grain, the total amount of electricity furnished to the anode reaction on the aluminum sheet up until completion of the electrolytic reaction is preferably at least 150 C/dm$^2$, and more preferably at least 170 C/dm$^2$, but preferably not more than 600 C/dm$^2$, and more preferably not more than 500 C/dm$^2$. The current density at this time is preferably 20 to 100 A/dm$^2$ at the peak current value when an alternating current is used, and preferably 20 to 100 A/dm$^2$ when a direct current is used.

When the preliminary electrolysis described below is carried out prior to nitric acid electrolysis, more uniform pits are formed in nitric acid electrolysis.

Preliminary electrolysis is a step in which the starting points for pit formation during nitric acid electrolysis are formed. Pits that serve as starting points can be uniformly created on the surface by carrying out a slight degree of electrolysis using very highly corrosive hydrochloric acid that is not readily affected by the quality of the aluminum sheet.

In preliminary electrolysis, the hydrochloric acid concentration is preferably 1 to 15 g/L, and the amount of electricity when the aluminum sheet serves as the anode is preferably 30 to 70 C/m$^2$.

Following preliminary electrolysis, it is desirable to carry out alkali etching to remove smut. The amount of aluminum dissolved in alkali etching is preferably 0.2 to 0.6 g/m$^2$.

Electrochemical Graining Treatment in a Hydrochloric Acid-Containing Aqueous Solution The hydrochloric acid-containing aqueous solution may be one that is employed in conventional electrochemical graining treatment using a direct current or an alternating current. Specifically, use can be made of a solution prepared by adding one or more hydrochloric acid or nitric acid compound containing a nitrate ion (e.g., aluminum nitrate, sodium nitrate, ammonium nitrate) or a chloride ion (e.g., aluminum chloride, sodium chloride, ammonium chloride) in an amount ranging from 1 g/L to saturation to an aqueous hydrochloric acid solution having a concentration of 1 to 30 g/L, and preferably 2 to 10 g/L. The above-mentioned compound which forms a complex with copper may also be added in an amount of 1 to 200 g/L. The hydrochloric acid-containing aqueous solution may have dissolved therein metals or the like which are present in the aluminum alloy, such as iron, copper, manganese, nickel, titanium, magnesium and silicon. Hypochlorous acid and hydrogen peroxide may be added in an amount of 1 to 100 g/L.

The hydrochloric acid solution is most preferably an aqueous solution having an aluminum ion concentration of 3 to 7 g/L, and preferably 4 to 6 g/L, obtained by adding 27 to 63 g/L of the aluminum salt (aluminum chloride, $AlCl_3.6H_2O$) to an aqueous solution containing preferably 2 to 10 g/L of hydrochloric acid. By carrying out electrochemical graining treatment using such a hydrochloric acid solution, the surface shape obtained by graining treatment is uniform, unevenness due to graining treatment does not arise--regardless of whether a low-purity aluminum rolled sheet or a high-purity aluminum rolled sheet is used, and a lithographic printing plate can be obtained which has both a long press life and an excellent scumming resistance.

The hydrochloric acid-containing aqueous solution has a temperature of preferably at least 25° C., and more preferably at least 30° C., but preferably not more than 55° C., and more preferably not more than 40° C.

Treatment conditions such as additives included in the hydrochloric acid-containing aqueous solution, the apparatus and power supply used, and the current density, flow rate and temperature may be the same as those employed in known electrochemical graining treatment processes. The power supply used in electrochemical graining treatment may be an AC or DC power supply, although an AC power supply is especially preferred.

Hydrochloric acid by itself has a strong ability to dissolve aluminum, and so micropits can be formed on the surface with the application of just a slight degree of electrolysis. These micropits have an average diameter of 0.01 to 0.4 μm, and arise uniformly over the entire surface of the aluminum sheet.

Further increasing the amount of electricity causes pits to form which have an average diameter of 1 to 15 μm and bear on the surface thereof micropits with an average diameter of 0.01 to 0.4 μm. To obtain such a grained texture on the surface of the aluminum sheet, the total amount of electricity furnished to the anode reaction on the aluminum sheet up until completion of the electrolytic reaction is preferably at least 10 C/dm$^2$, more preferably at least 50 C/dm$^2$, and even more preferably at least 100 C/dm$^2$, but preferably not more than 2,000 C/dm$^2$, and more preferably not more than 600 C/dm$^2$.

In cases where hydrochloric acid electrolysis is carried out as the first electrolytic graining treatment (Embodiments 3 to 5), by furnishing a large total amount of electricity of 150 to 2,000 C/dm$^2$ to the anode reaction, large crater-like undulations can also be formed at the same time. Pits which have an average diameter of 1 to 15 μm and bear on the surface thereof micropits with an average diameter of 0.01 to 0.4 μm will form in such cases as well. The current density at this time is preferably 20 to 100 A/dm$^2$ (at the peak current value).

When the aluminum sheet is subjected to hydrochloric acid electrolysis using the large amount of current indicated above, micropits can be made to form at the same time as the large undulations. The scumming resistance can be enhanced by using the second alkali etching treatment described later in the specification to make these large undulations more uniform.

The first electrolytic graining treatment which uses a nitric acid or hydrochloric acid-containing aqueous solution may be carried out in accordance with, for example, the electrochemical graining processes (electrolytic graining processes) described in JP 48-28123 B and GB 896,563 B. These electrolytic graining processes use an alternating current having a sinusoidal waveform, although they may also be carried out using special waveforms like those described in JP 52-58602 A. Use can also be made of the waveforms described in JP 3-79799 A. Other processes that may be employed for this purpose include those described in JP 55-158298 A, JP 56-28898 A, JP 52-58602 A, JP 52-152302 A, JP 54-85802 A, JP 60-190392 A, JP 58-120531 A, JP 63-176187 A, JP 1-5889 A, JP 1-280590 A, JP 1-118489 A, JP 1-148592 A, JP 1-178496 A, JP 1-188315 A, JP 1-154797 A, JP 2-235794 A, JP 3-260100 A, JP 3-253600 A, JP 4-72079 A, JP 4-72098 A, JP 3-267400 A and JP 1-141094 A. In addition to the above, electrolytic treatment can also be carried out using alternating currents of special frequency such as have been proposed in connection with methods for manufacturing electrolytic capacitors. These are described in, for example, U.S. Pat. No. 4,276,129 and U.S. Pat. No. 4,676,879.

Various electrolytic cells and power supplies have been proposed for use in electrolytic treatment. For example, use may be made of those described in U.S. Pat. No. 4,203,637, JP 56-123400 A, JP 57-59770 A, JP 53-12738 A, JP 53-32821 A, JP 53-32822 A, JP 53-32823 A, JP 55-122896 A, JP 55-132884 A, JP 62-127500 A, JP 1-52100 A, JP 1-52098 A, JP 60-67700 A, JP 1-230800 A, JP 3-257199 A, JP 52-58602 A, JP 52-152302 A, JP 53-12738 A, JP 53-12739 A, JP 53-32821 A, JP 53-32822 A, JP 53-32833 A, JP 53-32824 A, JP 53-32825, JP 54-85802 A, JP 55-122896 A, JP 55-132884 A, JP 48-28123 B, JP 51-7081 B, JP 52-133838 A, JP 52-133840 A, JP 52-133844 A, JP 52-133845 A, JP 53-149135 A and JP 54-146234 A.

When the aluminum sheet is subjected to continuous electrolytic graining treatment, the aluminum ion concentration in the alkali solution rises over time, as a result of which fluctuations will occur in the shape of the recessed portions and protruded portions that are formed on the aluminum sheet by the first electrolytic graining treatment. It is thus advantageous to control the composition of the nitric acid electrolyte solution or hydrochloric acid electrolyte solution as follows.

First, a matrix of the electrical conductivity, specific gravity and temperature or a matrix of the conductivity, ultrasonic wave propagation velocity and temperature is prepared with respect to a matrix of the nitric acid concentration or hydrochloric acid concentration and the aluminum ion concentration. The solution composition is then measured based on either the conductivity, specific gravity and temperature or the conductivity, ultrasonic wave propagation velocity and temperature, and nitric acid or hydrochloric acid and water are added up to control target values for the liquid composition. Next, the electrolyte solution which has increased in volume with the addition of nitric acid or hydrochloric acid and water is allowed to overflow from a circulation tank, thereby holding the amount of solution constant. The nitric acid added may be industrial grade 30 to 70 wt % nitric acid. The hydrochloric acid added may be industrial grade 30 to 40 wt % hydrochloric acid.

The conductivity meter and hydrometer used to measure electrical conductivity and specific gravity are each preferably temperature-compensated instruments. The hydrometer is preferably a pressure differential hydrometer.

To measure the liquid composition to high accuracy, it is preferable that samples collected from the electrolyte solution for the purpose of measurement be furnished for measurement after first being controlled to a fixed temperature (e.g., 40±0.5° C.) using a heat exchanger other than that for the electrolyte solution.

Figure 5:
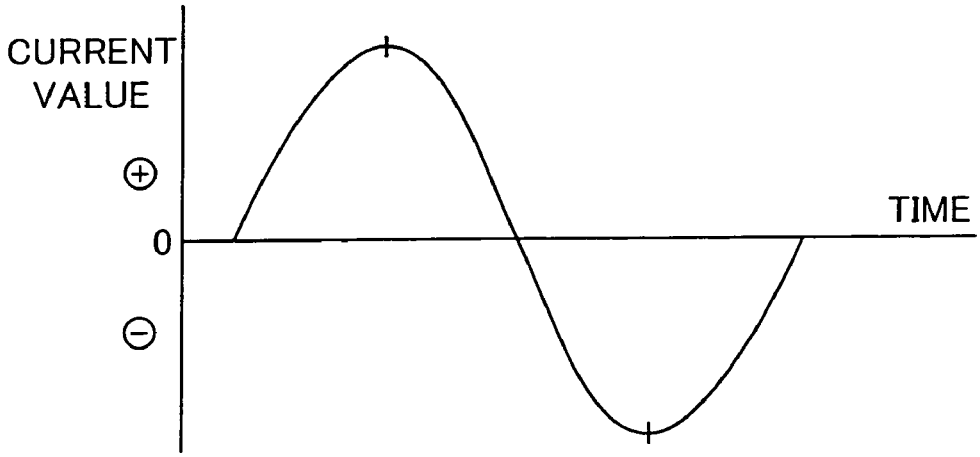
FIG. 5 is a graph showing an example of a sine wave that may be used in electrochemical graining treatment in the inventive method of manufacturing a lithographic printing plate support.

No particular limitation is imposed on the AC power supply waveform used in electrochemical graining. For example, a sinusoidal, square, trapezoidal or triangular waveform may be used. Of these, a sinusoidal, square or trapezoidal waveform is preferred. A trapezoidal waveform is especially preferred. In hydrochloric acid electrolysis, a sinusoidal waveform is especially preferred because it facilitates the formation of uniform pits having an average diameter of 1 μm or more. "Sinusoidal waveform" refers herein to a waveform like that shown in FIG. 5.

Figure 2:
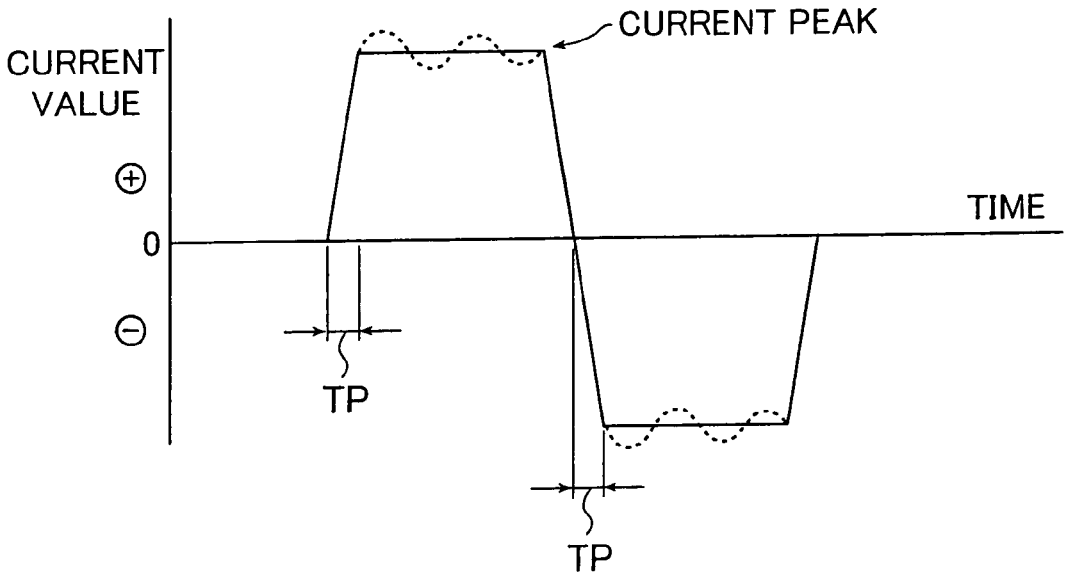
FIG. 2 is a graph showing an example of an alternating current waveform that may be used in electrochemical graining treatment in the inventive method of manufacturing a lithographic printing plate support.

"Trapezoidal waveform" refers herein to a waveform like that shown in FIG. 2. In this trapezoidal waveform, it is preferable for the time TP until the current reaches a peak from zero to be 0.5 to 3.0 ms. At a TP of more than 3 ms, particularly when a nitric acid-containing aqueous solution is used, the aluminum sheet tends to be affected by trace ingredients in the electrolyte solution, such as ammonium ions, that spontaneously increase during electrolytic treatment, making it difficult to carry out uniform graining. As a result, there is a tendency for the lithographic printing plate obtained from the aluminum sheet to have a diminished scumming resistance.

The alternating current may have a duty ratio (ta/T, a ratio of the anode reaction in one cycle) of 1:2 to 2:1. As noted in JP 5-195300 A, a duty ratio of 1:1 is preferred in an indirect power feed system that does not use a conductor roll to feed current to the aluminum.

Alternating current having a frequency of 0.1 to 120 Hz may be used, although a frequency of 50 to 70 Hz is preferable from the standpoint of the equipment. At a frequency lower than 50 Hz, the carbon electrode serving as the main electrode tends to dissolve more readily. On the other hand, at a frequency higher than 70 Hz, the power supply circuit is more readily subject to the influence of inductance thereon, increasing the power supply costs.

Figure 3:
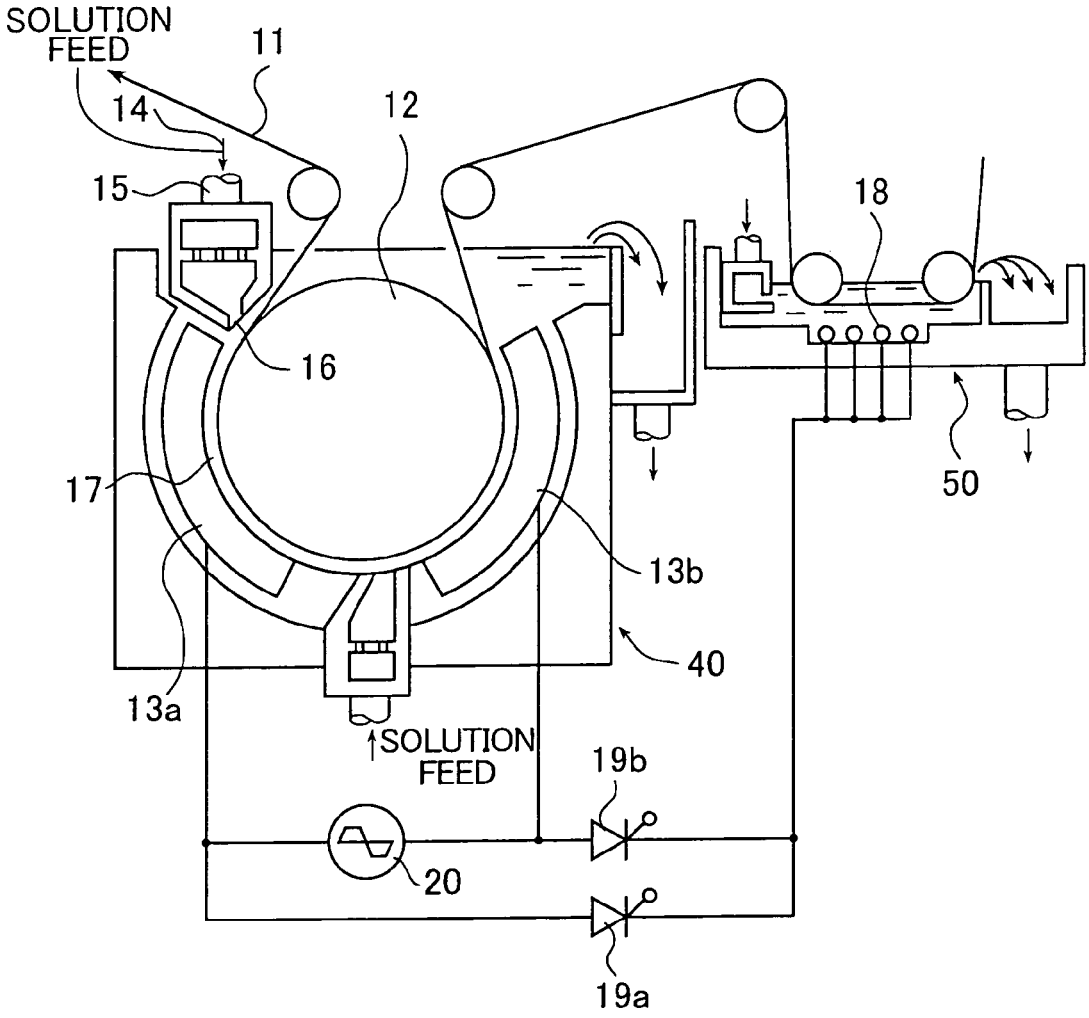
FIG. 3 is a side view of a radial electrolytic cell apparatus such as may be employed to carry out electrochemical graining treatment with alternating current in the inventive method of manufacturing a lithographic printing plate support.

FIG. 3 is a side view of a radial electrolytic cell such as may be employed to carry out electrochemical graining treatment using alternating current in the inventive method of manufacturing a lithographic printing plate support.

One or more AC power supply may be connected to the electrolytic cell. To control the anode/cathode current ratio of the alternating current applied to the aluminum sheet opposite the main electrodes and thereby carry out uniform graining and to dissolve carbon from the main electrodes, it is advantageous to provide an auxiliary anode and divert some of the alternating current as shown in FIG. 3. FIG. 3 shows an aluminum sheet 11, a radial drum roller 12, main electrodes 13*a* and 13*b*, an electrolytic treatment solution 14, a solution feed inlet 15, a slit 16, a solution channel 17, an auxiliary anode 18, thyristors 19*a* and 19*b*, an AC power supply 20, a main electrolytic cell 40 and an auxiliary anode cell 50. By using a rectifying or switching device to divert some of the current value as direct current to an auxiliary anode provided in a separate cell from that containing the two main electrodes, it is possible to control the ratio between the current value furnished for the anode reaction which acts on the aluminum sheet opposite the main electrodes and the current value furnished for the cathode reaction. The ratio between the amount of electricity furnished to the anode reaction and the amount of electricity furnished to the cathode reaction (electricity for cathode reaction/electricity for anode reaction) on the aluminum sheet opposite the main electrodes is preferably from 0.3 to 0.95.

Any known electrolytic cell employed for surface treatment, including vertical, flat and radial type electrolytic cells, may be used to carry out electrochemical graining treatment in the inventive method of manufacturing a lithographic printing plate support. Radial-type electrolytic cells such as those described in JP 5-195300 A are especially preferred. The electrolyte solution is passed through the electrolytic cell either parallel or counter to the direction in which the aluminum web advances through the process.

Electrochemical graining treatment with direct current may be carried out using an electrolyte solution of a type employed in conventional electrochemical graining treatment with direct current. Specifically, use may be made of the same electrolyte solutions as those which are employed in the above-described electrochemical graining treatment with alternating current.

The DC power supply waveform used in electrochemical graining treatment is not subject to any particular limitation so long as the current is one which does not undergo a change of polarity. For example, use may be made of pulse waves, continuous direct current, or commercial alternating current that has been full-wave rectified with a thyristor. Continuous direct current that has been smoothed is preferred.

Electrochemical graining treatment using direct current may be carried out as a batch process, a semi-continuous process or a fully continuous process. A fully continuous process is preferred.

The apparatus used to carry out electrochemical graining treatment with direct current is not subject to any particular limitation, so long as it is one which applies a DC voltage across alternately disposed anodes and cathodes and allows the aluminum sheet to pass through while maintaining an interval between it and the anodes and cathodes.

Figure 6:
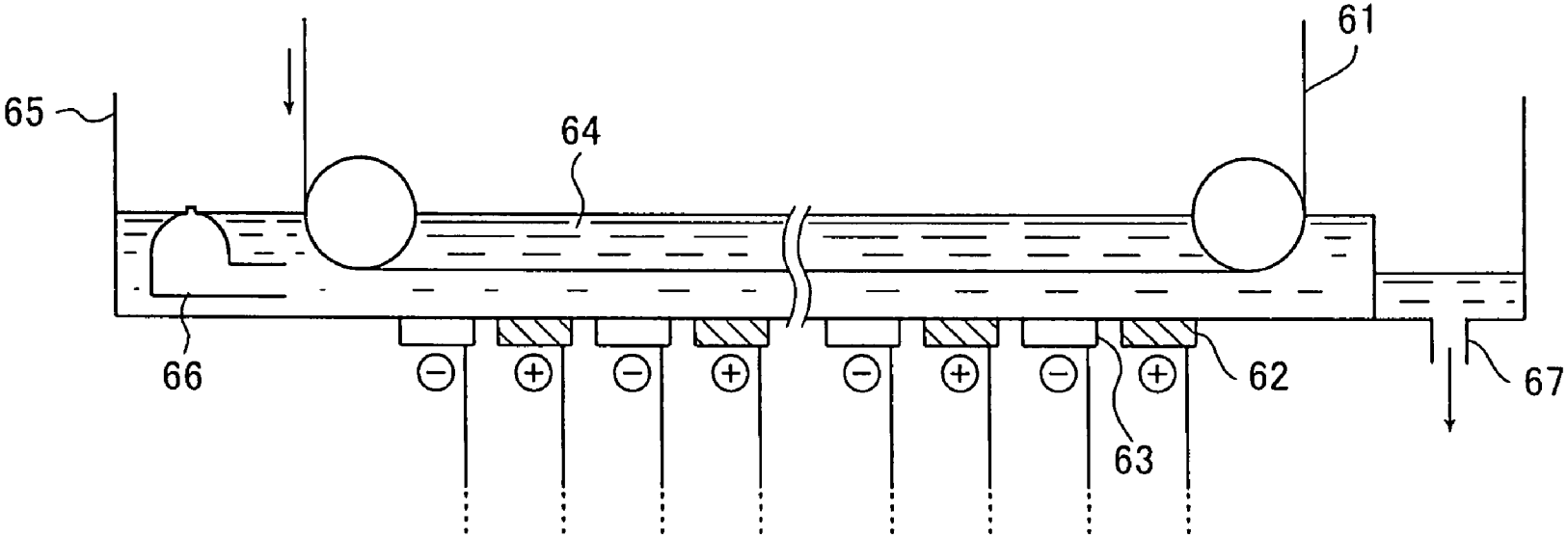
FIG. 6 is a side view of an apparatus that may be used for electrochemical graining treatment with direct current in the inventive method of manufacturing a lithographic printing plate support.

An illustrative example is the apparatus having one electrolytic cell shown in FIG. 6. In FIG. 6, an aluminum sheet 61 passes through an electrolytic cell 65 filled with an electrolyte solution 64. A DC voltage is applied across anodes 62 and cathodes 63 which are alternately arranged on the electrolytic cell 65. In the electrolytic cell 65, the electrolyte solution 64 is supplied by a feed nozzle 66 and discharged through a discharge line 67.

Figure 7:
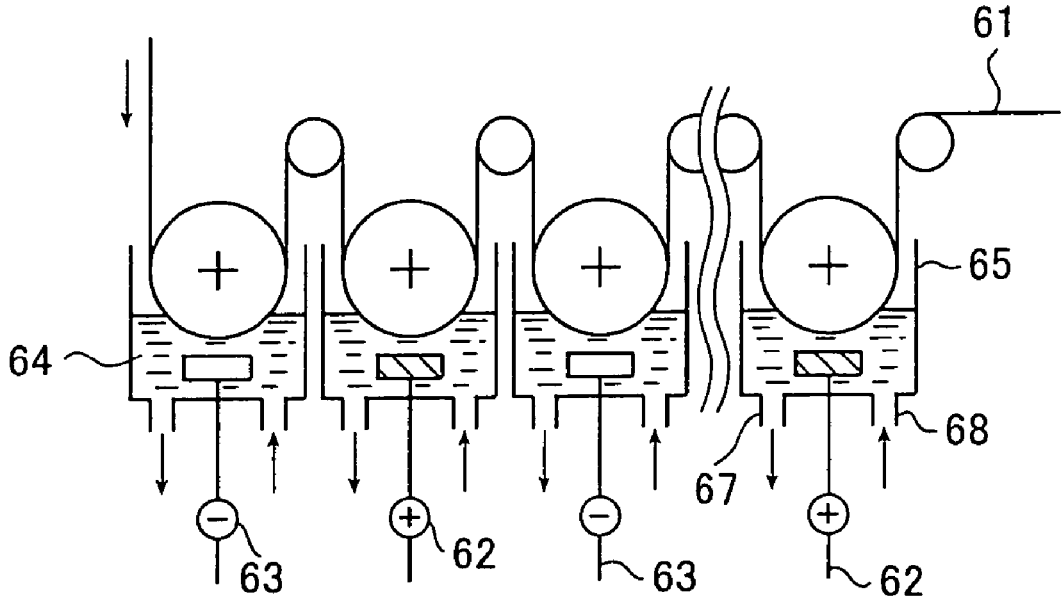
FIG. 7 is a side view of another apparatus that may be used for electrochemical graining treatment with direct current in the inventive method of manufacturing a lithographic printing plate support.

Another type of apparatus that may be used for the same purpose is one like that shown in FIG. 7 which has separate electrolytic cells for each anode 62 and cathode 63. In FIG. 7, the aluminum sheet 61 passes through a plurality of electrolytic cells 65 filled with an electrolyte solution 64. The respective electrolytic cells have disposed therein, in an alternating arrangement, an anode 62 or a cathode 63. A DC voltage is applied across the alternately disposed anodes 62 and cathodes 63. In each electrolytic cell 65, the electrolyte solution 64 is supplied by a feed line 68 and discharged through a discharge line 67.

Any known electrodes that can be employed in electrochemical graining treatment may be used here without particular limitation.

Illustrative examples of the anode include anodes made of a valve metal such as titanium, tantalum or niobium plated or clad with a platinum group metal; anodes made of a valve metal on which a platinum group metal oxide has been coated or sintered; and anodes made of aluminum or stainless steel. Of these, anodes made of a platinum-clad valve metal are preferred. The life of the anode can be further extended by a method such as water cooling in which water is passed through the interior of the electrode.

The anode may be made of, for example, a metal or other substance which, based on a Pourbaix diagram, does not dissolve at a negative electrode potential. Of such substances, carbon is preferred.

The arrangement of the electrodes may be suitably selected according to the desired undulation structure at the surface of the aluminum sheet. Moreover, the undulation structure can be adjusted by changing the length of the anodes and cathodes in the direction of advance by the aluminum sheet, changing the speed of passage by the aluminum sheet, and varying such factors as the flow rate, temperature and composition of the electrolyte solution and the current density. When the anode cells and the cathode cells are provided as separate and individual electrolytic cells as in the apparatus shown in FIG. 7, the electrolytic conditions in each of these cells may be varied.

Measurement of the average diameter of the pits formed in the first electrolytic graining treatment is typically carried out by, for example, using an electron microscope to obtain direct overhead images of the support surface at a magnification of 2,000 to 5,000×, selecting at least 50 pits with continuous ring-like edges in each of the resulting electron micrographs, reading off the diameter of each pit, and computing the average pit diameter.

To minimize the variability of measurement, equivalent circle diameter measurements can be carried out using commercially available image analysis software. In this case, the above electron micrographs are scanned and digitized, then converted to binary values with software, following which the equivalent circle diameters are determined.

When the inventors carried out measurements of the average diameter of pits, the inventors obtained substantially the same results from both visual measurement and digital processing.

Following completion of the first electrolytic graining treatment, it is desirable to remove the solution from the aluminum sheet with nip rollers, rinse the sheet with water for 1 to 10 seconds, then remove the water with nip rollers.

Rinsing treatment is preferably carried out using a spray line. The spray line used in rinsing treatment is typically one having a plurality of spray tips, each of which discharges a fan-like spray of water and is situated along the width of the aluminum sheet. The interval between the spray tips is preferably 20 to 100 mm, and the amount of water discharged per spray tip is preferably 1 to 20 L/min. Rinsing with a plurality of spray lines is preferred.

Second Alkali Etching Treatment

The purpose of the second alkali etching treatment carried out between the first electrolytic graining treatment and the second electrolytic graining treatment is to dissolve smut that arises in the first electrolytic graining treatment and to dissolve the edges of the pits formed by the first electrolytic graining treatment. The present step dissolves the edges of the large pits formed by the first electrolytic graining treatment, smoothing the surface and discouraging ink from catching on such edges. As a result, presensitized plates of excellent scumming resistance can be obtained.

Because the second alkali etching treatment is basically the same as the first alkali etching treatment, only those points that differ are described below.

In the second alkali etching treatment, the etching amount is preferably at least 0.05 g/m$^2$, and more preferably at least 0.1 g/m$^2$, but preferably not more than 4 g/m$^2$, and more preferably not more than 3.5 g/m$^2$. At an etching amount of at least 0.05 g/m$^2$, the edges of the pits that formed in the first electrolytic graining treatment become smooth in non-image areas of the lithographic printing plate, which discourages ink from catching and results in an excellent scumming resistance. At an etching amount of not more than 4 g/m$^2$, the surface recessed portions and protruded portions that formed in the first electrolytic graining treatment become larger, resulting in an excellent press life.

In the second alkali etching treatment, the alkali solution concentration is preferably at least 30 g/L, and more preferably at least 300 g/L, but preferably not more than 500 g/L, and more preferably not more than 450 g/L.

It is desirable for the alkali solution to contain aluminum ions. The aluminum ion concentration is preferably at least 1 g/L, and more preferably at least 50 g/L, but preferably not more than 200 g/L, and more preferably not more than 150 g/L.

Second Desmutting Treatment

After the second alkali etching treatment has been carried out, it is preferable to carry out acid pickling (second desmutting treatment) to remove contaminants (smut) remaining on the surface of the aluminum sheet. The second desmutting treatment can be carried out in the same way as the first desmutting treatment.

It is preferable to use nitric acid or sulfuric acid in the second desmutting treatment. The use of an acidic solution containing 1 to 400 g/L of acid and 0.1 to 8 g/L of aluminum ions is advantageous.

If sulfuric acid is used, treatment may be carried out using a solution prepared by dissolving aluminum sulfate to an aluminum ion concentration of 0.1 to 5 g/L in aqueous sulfuric acid having a sulfuric acid concentration of 100 to 350 g/L. Alternatively, treatment may be carried out using electrolyte solution overflow from the anodizing treatment described later in this specification.

In the second desmutting treatment, the treatment time is preferably at least 1 second, and more preferably at least 4 seconds, but preferably not more than 60 seconds, and more preferably not more than 20 seconds.

The aqueous acid solution used in this step has a temperature of preferably at least 20° C., and more preferably at least 30° C., but preferably not more than 70° C., and even more preferably not more than 60° C.

Second Electrolytic Graining Treatment

In Embodiments 1, 5 and 6, for example, the second electrolytic graining treatment involves carrying out electrochemical graining treatment using an alternating current or direct current in a hydrochloric acid-containing aqueous solution. In this invention, by combining the above-described first electrolytic graining treatment with this second electrolytic graining treatment, a complex patter of recessed and protruded portions can be formed on the surface of the aluminum sheet, which in turn enables an excellent press life to be achieved. Also, the second electrolytic graining treatment forms pits having an average diameter of 0.01 to 0.4 μm on the aluminum sheet surface that has been smoothened by second alkali etching. This enables a longer press life to be achieved.

Hydrochloric acid electrolysis carried out as the second electrolytic graining treatment after the first electrolytic graining treatment is basically the same as the hydrochloric acid electrolysis described above in connection with the first electrolytic graining treatment.

The total amount of electricity furnished to the anode reaction on the aluminum sheet during electrochemical graining within an aqueous solution containing hydrochloric acid (hydrochloric acid electrolysis) up until the completion of electrochemical graining treatment can be selected from a range of 10 to 200 C/dm$^2$, preferably 10 to 100 C/dm$^2$, and most preferably 50 to 80 C/dm$^2$.

In cases where hydrochloric acid electrolysis is carried out as the first electrolytic graining treatment and the second electrolytic graining treatment, the total amount of electricity $Q_1$ furnished to the anode reaction up until completion of the electrolytic reaction in the first electrolytic graining treatment is preferably larger than the total amount of electricity $Q_2$ furnished to the anode reaction up until completion of the electrolytic reaction in the second electrolytic graining treatment (i.e., $Q_1>Q_2$). Treatment in this manner increases the surface area of the aluminum sheet on account of the pits having an average diameter of 1 to 15 μm that have formed in the first electrolytic graining treatment, thus improving adhesion between the aluminum sheet and the image recording layer placed thereon and extending the press life of the printing plate.

Third Alkali Etching Treatment

The purpose of the third alkali etching treatment carried out after the second electrolytic graining treatment is to dissolve smut that arises in the second electrolytic graining treatment and to dissolve the edges of the pits formed by the second electrolytic graining treatment. Because the third alkali etching treatment is basically the same as the first alkali etching treatment, only those points that differ are described below.

In the third alkali etching treatment, the etching amount is preferably at least 0.05 g/m$^2$, and more preferably at least 0.1 g/m$^2$, but preferably not more than 0.3 g/m$^2$, and more preferably not more than 0.25 g/m$^2$. At an etching amount of at least 0.05 g/m$^2$, the edges of the pits that formed in the second electrolytic graining treatment become smooth in non-image areas of the lithographic printing plate, which discourages ink from catching and results in an excellent scumming resistance. At an etching amount of up to 0.3 g/m$^2$, the surface recessed portions and protruded portions formed in the first electrolytic graining treatment and the second electrolytic graining treatment become larger, resulting in a long press life.

In the third alkali etching treatment, the alkali solution has a concentration of preferably at least 30 g/L. To keep the recessed portions and protruded portions that have formed in the preceding electrolytic graining treatment from becoming too small, the alkali solution concentration is preferably not more than 100 g/L, and more preferably not more than 70 g/L.

The alkali solution preferably contains aluminum ions. The aluminum ion concentration is preferably at least 1 g/L, and more preferably at least 3 g/L, but preferably not more than 50 g/L, and more preferably not more than 8 g/L. Such an alkali solution can be adjusted using, for example, water, 48 wt % sodium hydroxide aqueous solution, and sodium aluminate.

In the third alkali etching treatment, the temperature of the alkali solution is preferably at least 25° C., and more preferably at least 30° C., but preferably not more than 60° C., and more preferably not more than 50° C. The treatment time is preferably at least 1 second, and more preferably at least 2 seconds, but preferably not more than 30 seconds, and more preferably not more than 10 seconds.

Third Desmutting Treatment

After the third alkali etching treatment has been carried out, it is preferable to carry out acid pickling (third desmutting treatment) to remove contaminants (smut) remaining on the surface of the aluminum sheet. Because the third desmutting treatment can be carried out in basically the same way as the first desmutting treatment, only those points that differ are described below.

The third desmutting treatment employs the same type of solution as the electrolyte solution (e.g., sulfuric acid) used in the anodizing treatment subsequently carried out, and so a rinsing step may be preferably omitted between the third desmutting treatment and the anodizing treatment.

In the third desmutting treatment, it is preferable to use an acidic solution containing 5 to 400 g/L of acid and 0.5 to 8 g/L of aluminum ions. When sulfuric acid is used, it is preferable to dissolve aluminum sulfate in aqueous sulfuric acid having a sulfuric acid concentration of 100 to 350 g/L in such a way as to adjust the aluminum ion concentration to 1 to 5 g/L.

The treatment time is preferably at least 1 second, and more preferably at least 4 seconds, but preferably not more than 60 seconds, and more preferably not more than 15 seconds.

If the desmutting treatment solution used in the third desmutting treatment is the same type of solution as the electrolyte solution used in the anodizing treatment subsequently carried out, removal of the solution with nip rollers following desmutting treatment and rinsing treatment may be omitted.

Anodizing Treatment

The aluminum sheet treated as described above is also administered anodizing treatment. Anodizing treatment can be carried out by any suitable method used in the field to which the present invention relates. More specifically, an anodized layer can be formed on the surface of the aluminum sheet by passing a current through the aluminum sheet as the anode in, for example, a solution having a sulfuric acid concentration of 50 to 300 g/L and an aluminum concentration of up to 5 wt %. The solution used for anodizing treatment includes any one or combination of, for example, sulfuric acid, phosphoric acid, chromic acid, oxalic acid, sulfamic acid, benzenesulfonic acid and amidosulfonic acid.

It is acceptable for ingredients ordinarily present in at least the aluminum sheet, electrodes, tap water, ground water and the like to be present in the electrolyte solution. In addition, secondary and tertiary ingredients may be added. Here, "second and tertiary ingredients" includes, for example, the ions of metals such as sodium, potassium, magnesium, lithium, calcium, titanium, aluminum, vanadium, chromium, manganese, iron, cobalt, nickel, copper and zinc; cations such as ammonium ions; and anions such as nitric acid ions, carbonic acid ions, chloride ions, phosphoric acid ions, fluoride ions, sulfite ions, titanic acid ions, silicic acid ions and boric acid ions. These may be present in a concentration of about 0 to 10,000 ppm.

The anodizing treatment conditions vary empirically according to the electrolyte solution used, although it is generally suitable for the solution to have a concentration of 1 to 80 wt % and a temperature of 5 to 70° C., and for the current density to be 0.5 to 60 A/dm$^2$, the voltage to be 1 to 100 V, and the electrolysis time to be 15 seconds to 50 minutes. These conditions may be adjusted to obtain the desired anodized layer weight.

Methods that may be used to carry out anodizing treatment include those described in JP 54-81133 A, JP 57-47894 A, JP 57-51289 A, JP 57-51290 A, JP 57-54300 A, JP 57-136596 A, JP 58-107498 A, JP 60-200256 A, JP 62-136596 A, JP 63-176494 A, JP 4-176897 A, JP 4-280997 A, JP 6-207299 A, JP 5-24377 A, JP 5-32083 A, JP 5-125597 A and JP 5-195291 A Of these, as described in JP 54-12853 A and JP 48-45303 A, it is preferable to use a sulfuric acid solution as the electrolyte solution. The electrolyte solution has a sulfuric acid concentration of preferably 10 to 300 g/L (1 to 30 wt %), and more preferably 50 to 200 g/L (5 to 20 wt %), and an aluminum ion concentration of preferably 1 to 25 g/L (0.1 to 2.5 wt %), and more preferably 2 to 10 g/L (0.2 to 1 wt %). Such an electrolyte solution can be prepared by adding a compound such as aluminum sulfate to dilute sulfuric acid having a sulfuric acid concentration of 50 to 200 g/L.

Control of the electrolyte solution composition is typically carried out using a method similar to that employed in nitric acid electrolysis, as described above. That is, control is preferably achieved by preparing a matrix of the electrical conductivity, specific gravity and temperature or a matrix of the conductivity, ultrasonic wave propagation velocity and temperature with respect to a matrix of the sulfuric acid concentration and the aluminum ion concentration.

The electrolyte solution has a temperature of preferably 25 to 55° C., and more preferably 30 to 50° C.

When anodizing treatment is carried out in an electrolyte solution containing sulfuric acid, direct current or alternating current may be applied across the aluminum sheet and the counterelectrode.

When a direct current is applied to the aluminum sheet, the current density is preferably 1 to 60 A/dm$^2$, and more preferably 5 to 40 A/dm$^2$.

To keep burnt deposits (areas of the anodized layer which are thicker than surrounding areas) from arising on portions of the aluminum sheet due to the concentration of current when anodizing treatment is carried out as a continuous process, it is preferable to apply current at a low density of 5 to 10 A/dm$^2$ at the start of anodizing treatment and to increase the current density to 30 to 50 A/dm$^2$ or more as anodizing treatment proceeds.

Specifically, it is preferable for current from the DC power supplies to be allocated such that current from downstream DC power supplies is equal to or greater than current from upstream DC power supplies. Current allocation in this way will discourage the formation of burnt deposits, enabling high-speed anodization to be carried out.

When anodizing treatment is carried out as a continuous process, this is preferably done using a system that supplies power to the aluminum sheet through the electrolyte solution.

By carrying out anodizing treatment under such conditions, a porous film having numerous micropores can be obtained. These micropores generally have an average diameter of about 5 to 50 nm and an average pore density of about 300 to 800 pores/μm$^2$.

The weight of the anodized layer is preferably 1 to 5 g/m$^2$. At less than 1 g/m$^2$, scratches readily form on the sheet. On the other hand, a weight of more than 5 g/m$^2$ requires a large amount of electrical power, which is economically disadvantageous. An anodized layer weight of 1.5 to 4 g/m$^2$ is more preferred. It is also desirable for anodizing treatment to be carried out in such a way that the difference in the anodized layer weight between the center of the aluminum sheet and the areas near the edges is not more than 1 g/m$^2$.

Examples of electrolyzing apparatuses that may be used in anodizing treatment include those described in JP 48-26638 A, JP 47-18739 A, JP 58-24517 B and JP 2001-11698 A.

Figure 4:
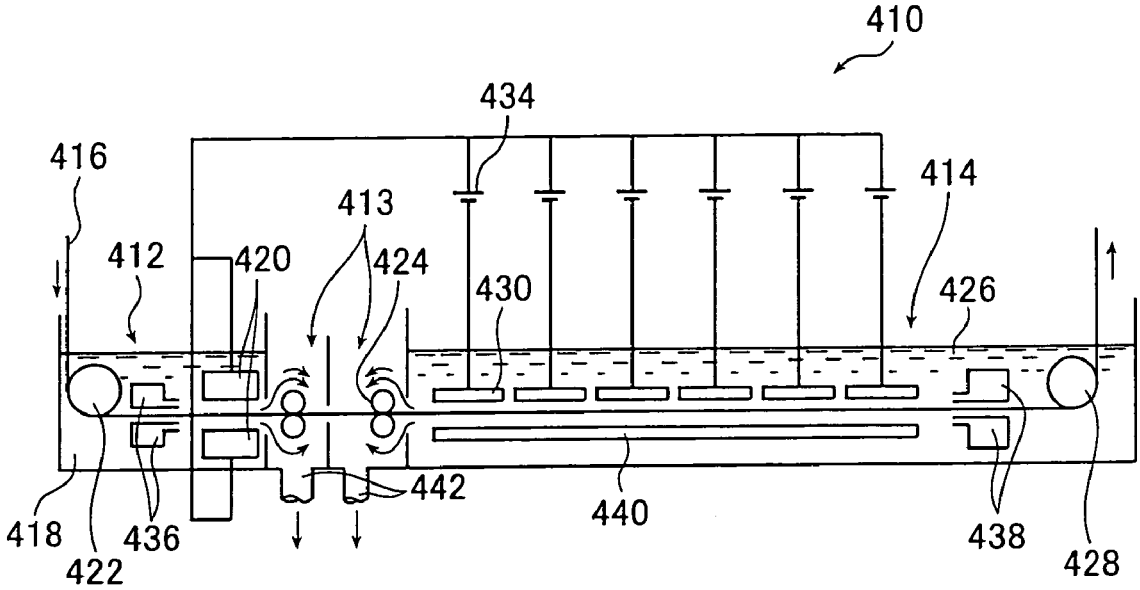
FIG. 4 is a schematic of an anodizing apparatus such as may be used in anodizing treatment in the inventive method of manufacturing a lithographic printing plate support.

Of these, an apparatus like that shown in FIG. 4 is preferred. FIG. 4 is a schematic of an apparatus for anodizing the surface of an aluminum sheet.

In the anodizing apparatus 410 shown in FIG. 4, to apply a current to an aluminum sheet 416 through an electrolyte solution, a power supplying cell 412 is disposed on the upstream side of the aluminum sheet 416 in the direction of advance by the sheet 416 and an anodizing treatment tank 414 is disposed on the downstream side. The aluminum sheet 416 is moved by path rollers 422 and 428 in the direction indicated by the arrows in the diagram. The power supplying cell 412 through which the aluminum sheet 416 first passes is provided with anodes 420 which are connected to the positive poles of DC power supplies 434; and the aluminum sheet 416 serves as the cathode. Hence, a cathode reaction arises at the aluminum sheet 416.

The anodizing treatment tank through which the aluminum sheet 416 next passes is provided with a cathode 430 which is connected to the negative poles of the DC power supplies 434; the aluminum sheet 416 serves as the anode. Hence, an anode reaction arises at the aluminum sheet 416, and an anodized layer forms on the surface of the aluminum sheet 416.

The aluminum sheet 416 and the cathode 430 are separated by an interval of preferably 50 to 200 mm. The cathode 430 may be made of aluminum. To facilitate the venting of hydrogen gas generated by the anode reaction from the system, it is preferable for the cathode 430 to be divided into a plurality of sections in the direction of advance by the aluminum sheet 416 rather than to be a single electrode having a broad surface area.

It is advantageous to provide, between the power supplying cell 412 and the anodizing treatment tank 414, an intermediate tank 413 that does not hold the electrolyte solution. By providing such an intermediate tank 413, the current can be kept from passing directly from the anode 420 to the cathode 430 and bypassing the aluminum sheet 416. It is preferable to minimize the bypass current by providing nip rollers 424 in the intermediate tank 413 to remove the solution from the aluminum sheet 416. The electrolyte solution removed by the nip rollers 424 is discharged outside of the anodizing apparatus 410 through a discharge outlet 442.

To lower the voltage loss, the electrolyte solution 418 that collects in the power supplying cell 412 is set to a higher temperature and/or concentration than the electrolyte solution 426 that collects in the anodizing treatment tank 414. Moreover, the composition, temperature and other characteristics of the electrolyte solutions 418 and 426 are set based on such considerations as the anodized layer forming efficiency, the shapes of micropores on the anodized layer, the hardness of the anodized layer, the voltage, and the cost of the electrolyte solution.

The power supplying cell 412 and the anodizing treatment tank 414 are supplied with electrolyte solutions injected by solution feed nozzles 436 and 438. To ensure that the distribution of electrolyte solution remains uniform and thereby prevent the localized concentration of current on the aluminum sheet 416 in the anodizing treatment tank 414, the solution feed nozzles 436 and 438 have a construction in which slits are provided to keep the flow of injected liquid constant in the width direction.

In the anodizing treatment tank 414, a shield 440 is provided on the opposite side of the aluminum sheet 416 from the cathode 430 to check the flow of current to the opposite side of the aluminum sheet 416 from the surface on which an anodized layer is to be formed. The interval between the aluminum sheet 416 and the shield 440 is preferably 5 to 30 mm. It is preferable to use a plurality of DC power supplies 434 with their positive poles connected in common, thereby enabling control of the current distribution within the anodizing treatment tank 414.

Sealing Treatment

Sealing treatment is carried out to seal micropores in the anodized layer. Such treatment can enhance the developability (sensitivity) of the presensitized plate.

Anodized layers are known to be porous films having micropores which extend in a direction substantially perpendicular to the surface of the film. In the present invention, it is advantageous to administer sealing treatment to a high sealing ratio. The sealing ratio is preferably at least 50%, more preferably at least 70%, and even more preferably at least 90%. "Sealing ratio," as used herein, is defined as follows.

$$\text{Sealing ratio}=[(\text{surface area before sealing})-(\text{sealing area after sealing})]/(\text{surface area before sealing})\times 100\%$$

The surface area can be measured using a simple BET-type surface area analyzer, such as Quantasorb (Yuasa Ionics Co., Ltd.).

Sealing may be carried out using any known method without particular limitation. Illustrative examples of sealing methods that may be used include hot water treatment, boiling water treatment, steam treatment, dichromate treatment, nitrite treatment, ammonium acetate treatment, electrodeposition sealing treatment, hexafluorozirconic acid treatment like that described in JP 36-22063 B, treatment with an aqueous solution containing a phosphate salt and an inorganic fluorine compound like that described in JP 9-244227 A, treatment with a sugar-containing aqueous solution like that described in JP 9-134002 A, treatment in a titanium and fluorine-containing aqueous solution like those described in JP 2000-81704 A and JP 2000-89466 A, and alkali metal silicate treatment like that described in U.S. Pat. No. 3,181,461.

One preferred type of sealing treatment is alkali metal silicate treatment. This can be carried out using a pH 10 to 13 aqueous solution of an alkali metal silicate at 25° C. that does not undergo solution gelation or dissolve the anodized layer, and by suitably selecting the treatment conditions, such as the alkali metal silicate concentration, the treatment temperature and the treatment time. Preferred alkali metal silicates include sodium silicate, potassium silicate and lithium silicate. The aqueous solution of alkali metal silicate may include also a hydroxide compound such as sodium hydroxide, potassium hydroxide or lithium hydroxide in order to increase the pH.

If necessary, an alkaline earth metal salt and/or a Group 4 (Group IVA) metal salt may also be included in the aqueous alkali metal silicate solution. Examples of suitable alkaline earth metal salts include the following water-soluble salts: nitrates such as calcium nitrate, strontium nitrate, magnesium nitrate and barium nitrate; and also sulfates, hydrochlorides, phosphates, acetates, oxalates, and borates of alkaline earth metals. Exemplary Group 4 (Group IVA) metal salts include titanium tetrachloride, titanium trichloride, titanium potassium fluoride, titanium potassium oxalate, titanium sulfate, titanium tetraiodide, zirconyl chloride, zirconium oxide and zirconium tetrachloride. These alkaline earth metal salts and Group 4 (Group IVA) metal salts may be used singly or in combinations of two or more thereof.

The concentration of the alkali metal silicate solution is preferably 0.01 to 10 wt %, and more preferably 0.05 to 5.0 wt %.

Another preferred type of sealing treatment is hexafluorozirconic acid treatment. Such treatment, which is carried out with a hexafluorozirconate such as sodium hexafluorozirconate and potassium hexafluorozirconate, provides the presensitized plate with an excellent sensitivity (developability). The tetrafluorozirconate solution used in this treatment has a concentration of preferably 0.01 to 2 wt %, and more preferably 0.1 to 0.3 wt %.

It is desirable for the hexafluorozirconate solution to contain sodium dihydrogenphosphate in a concentration of preferably 0.01 to 3 wt %, and more preferably 0.1 to 0.3 wt %.

The sealing treatment temperature is preferably 20 to 90° C., and more preferably 50 to 80° C.

The sealing treatment time (period of immersion in the solution) is preferably 1 to 20 seconds, and more preferably 5 to 15 seconds.

If necessary, sealing treatment may be followed by surface treatment such as the above-described alkali metal silicate treatment or treatment in which the aluminum sheet is immersed in or coated with a solution containing polyvinylphosphonic acid, polyacrylic acid, a polymer or copolymer having pendant groups such as sulfo groups, or any of the organic compounds, or salts thereof, having an amino group, phosphine group, phosphone group or phosphoric acid group mentioned in JP 11-231509 A.

Following sealing treatment, it is desirable to carry out the hydrophilizing treatment described below.

Hydrophilizing Treatment

Hydrophilizing treatment may be carried out after anodizing treatment or sealing treatment. Illustrative examples of suitable hydrophilizing treatments include the potassium hexafluorozirconate treatment described in U.S. Pat. No.

2,946,638, the phosphomolybdate treatment described in U.S. Pat. No. 3,201,247, the alkyl titanate treatment described in GB 1,108,559 B, the polyacrylic acid treatment described in DE 1,091,433 B, the polyvinylphosphonic acid treatments described in DE 1,134,093 and GB 1,230,447, the phosphonic acid treatment described in JP 44-6409 B, the phytic acid treatment described in U.S. Pat. No. 3,307,951, the treatment involving the divalent metal salt of a lipophilic organic polymeric compound described in JP 58-16893 A and JP 58-18291 A, treatment like that described in U.S. Pat. No. 3,860,426 in which an aqueous metal salt (e.g., zinc acetate)-containing hydrophilic cellulose (e.g., carboxymethyl cellulose) undercoat is provided, and a treatment like that described in JP 59-101651 A in which a sulfo group-bearing water-soluble polymer is undercoated.

Additional examples of suitable hydrophilizing treatments include undercoating treatment using the phosphates mentioned in JP 62-19494 A, the water-soluble epoxy compounds mentioned in JP 62-33692 A, the phosphoric acid-modified starches mentioned in JP 62-97892 A, the diamine compounds mentioned in JP 63-56498 A, the inorganic or organic salts of amino acids mentioned in JP 63-130391 A, the carboxyl or hydroxyl group-bearing organic phosphonic acids mentioned in JP 63-145092 A, the amino group and phosphonic acid group containing compounds mentioned in JP 63-165183 A, the specific carboxylic acid derivatives mentioned in JP 2-316290 A, the phosphate esters mentioned in JP 3-215095 A, the compounds having one amino group and one phosphorus oxo acid group mentioned in JP 3-261592 A, the phosphoric acid esters mentioned in JP 3-215095 A, the aliphatic or aromatic phosphonic acids (e.g., phenylphosphonic acid) mentioned in JP 5-246171 A, the sulfur atom-containing compounds (e.g., thiosalicylic acid) mentioned in JP 1-307745 A, and the phosphorus oxo acid group-bearing compounds mentioned in JP 4-282637 A.

Coloration with an acid dye as mentioned in JP 60-64352 A may also be carried out.

It is preferable to carry out hydrophilizing treatment by a method in which the aluminum sheet is immersed in an aqueous solution of an alkali metal silicate such as sodium silicate or potassium silicate, or is coated with a hydrophilic vinyl polymer or some other hydrophilic compound so as to form a hydrophilic undercoat.

Hydrophilizing treatment with an aqueous solution of an alkali metal silicate such as sodium silicate or potassium silicate can be carried out according to the processes and procedures described in U.S. Pat. Nos. 2,714,066 and 3,181,461.

Illustrative examples of suitable alkali metal silicates include sodium silicate, potassium silicate and lithium silicate. Suitable amounts of hydroxides such as sodium hydroxide, potassium hydroxide or lithium hydroxide may be included in the aqueous alkali metal silicate solution.

An alkaline earth metal salt or a Group 4 (Group IVA) metal salt may also be included in the aqueous alkali metal silicate solution. Examples of suitable alkaline earth metal salts include nitrates such as calcium nitrate, strontium nitrate, magnesium nitrate and barium nitrate; and also sulfates, hydrochlorides, phosphates, acetates, oxalates, and borates. Exemplary Group 4 (Group IVA) metal salts include titanium tetrachloride, titanium trichloride, titanium potassium fluoride, titanium potassium oxalate, titanium sulfate, titanium tetraiodide, zirconyl chloride, zirconium oxide and zirconium tetrachloride. These alkaline earth metal salts and Group 4 (Group IVA) metal salts may be used singly or in combinations of two or more thereof.

The amount of silicon adsorbed as a result of alkali metal silicate treatment can be measured with a fluorescent x-ray analyzer, and is preferably about 1.0 to 15.0 mg/m$^2$.

This alkali metal silicate treatment has the effect of enhancing the resistance at the surface of the lithographic printing plate support to dissolution by the alkali developer, suppressing the leaching of aluminum ingredients into the developer, and reducing the generation of sludge during development arising from developer fatigue.

Hydrophilizing treatment involving the formation of a hydrophilic undercoat can also be carried out in accordance with the conditions and procedures described in JP 59-101651 A and JP 60-149491 A.

Hydrophilic vinyl polymers that may be used in such a method include copolymers of a sulfo group-bearing vinyl polymerizable compound such as polyvinylsulfonic acid or sulfo group-bearing p-styrenesulfonic acid with a conventional vinyl polymerizable compound such as an alkyl (meth) acrylate. Examples of hydrophilic compounds that may be used in this method include compounds having at least one group selected from among —$NH_2$ groups, —COOH groups and sulfo groups.

Drying

After the lithographic printing plate support has been obtained as described above, it is advantageous to dry the surface of the support before providing an image recording layer thereon. Drying is preferably carried out after the support has been rinsed with water and the water removed with nip rollers following the final surface treatment.

The drying temperature is preferably at least 70° C., and more preferably at least 80° C., but preferably not more than 110° C., and more preferably not more than 100° C.

The drying time is preferably at least 1 second, and preferably at least 2 seconds, but preferably not more than 20 seconds, and more preferably not more than 15 seconds.

Control of the Solution Compositions

In the practice of the present invention, it is preferable for the compositions of the various solutions used in the above-described surface treatment to be controlled by the method described in JP 2001-121837 A. This typically involves first preparing a plurality of treatment solution samples to various concentrations, then measuring the ultrasonic wave propagation velocity at two solution temperatures for each sample and constructing a matrix-type data table based on the results. During treatment, it is preferable to measure the solution temperature and ultrasonic wave propagation velocity in real time and to control the concentration based on these measurements. In cases where an electrolyte solution having a sulfuric acid concentration of 250 g/L or more is used in desmutting treatment, controlling the concentration by the foregoing method is especially preferred.

The various electrolyte solutions used in electrolytic graining treatment and anodizing treatment preferably have a copper concentration of not more than 100 ppm. If the copper concentration is too high, copper will deposit onto the aluminum sheet when the production line stops. When the line starts moving again, the deposited copper may be transferred to the path rolls, which can cause uneven treatment.

Presensitized Plate

A presensitized plate can be obtained by providing an image recording layer on the lithographic printing plate support obtained according to this invention. A photosensitive composition may be used to form the image recording layer.

Preferred examples of photosensitive compositions that may be used in the present invention include thermal positive-working photosensitive compositions containing an alkali-soluble polymeric compound and a photothermal conversion substance (such compositions and the image recording layers obtained using these compositions are referred to below as "thermal positive-type" compositions and image recording layers), thermal negative-working photosensitive compositions containing a curable compound and a photothermal conversion substance (which compositions and the image recording layers obtained therefrom are similarly referred to below as "thermal negative-type" compositions and image recording layers), photopolymerizable photosensitive compositions (referred to below as "photopolymer-type" compositions), negative-working photosensitive compositions containing a diazo resin or a photo-crosslinkable resin (referred to below as "conventional negative-type" compositions), positive-working photosensitive compositions containing a quinonediazide compounds (referred to below as "conventional positive-type" compositions), and photosensitive compositions that do not require a special development step (referred to below as "non-treatment type" compositions).

Lithographic printing plate supports obtainable by the present invention, when made with a photosensitive composition and image recording layer of a thermal positive-type or thermal negative-type, for instance, are well-suited for use in computer-to-print (CTP) technology in which digitized image data is carried on a highly convergent beam of radiation such as laser light that is scanned over a presensitized plate to expose it, thus enabling the direct production of a lithographic printing plate without relying on the use of lith film.

These preferred photosensitive compositions are described below.

Thermal Positive-Type Photosensitive Compositions Photosensitive layer

Thermal positive-type photosensitive compositions contain an alkali-soluble polymeric compound and a photothermal conversion substance. In a thermal positive-type image recording layer, the photothermal conversion substance converts light energy such as from an infrared laser into heat, which heat efficiently eliminates interactions that lower the alkali solubility of the alkali-soluble polymeric compound.

The alkali-soluble polymeric compound may be, for example, a resin having an acidic group on the molecule, or a mixture of two or more such resins. Resins having an acidic group, such as a phenolic hydroxyl group, a sulfonamide groups (—$SO_2NH$—R, wherein R is a hydrocarbon group) or an active imino group (—$SO_2NHCOR$, —$SO_2NHSO_2R$ or —$CONHSO_2R$, wherein R is as defined above) are especially preferred on account of their solubility in alkali developers.

For an excellent film formability with exposure to light from an infrared laser, for example, resins having phenolic hydroxyl groups are especially desirable. Preferred examples of such resins include novolak resins such as phenol-formaldehyde resins, m-cresol-formaldehyde resins, p-cresol-formaldehyde resins, m-/p-mixed cresol-formaldehyde resins, and phenol/cresol mixture-formaldehyde resins (phenol-cresol-formaldehyde co-condensation resins) in which the cresol is m-cresol, p-cresol or a mixture of m- and p-cresol.

Additional preferred examples include the polymeric compounds mentioned in JP 2001-305722 A (especially paragraphs [0023] to [0042]), the polymeric compounds having recurring units of general formula (1) mentioned in JP 2001-215693 A, and the polymeric compounds mentioned in JP 2002-311570 A (especially paragraph [0107]).

To provide a good recording sensitivity, the photothermal conversion substance is preferably a pigment or dye that absorbs light in the infrared range at a wavelength of 700 to 1200 nm. Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium dyes and metal-thiolate complexes (e.g., nickel-thiolate complexes). Of these, cyanine dyes are preferred. The cyanine dyes of general formula (I) mentioned in JP 2001-305722 A are especially preferred.

A dissolution inhibitor may be included in thermal positive-type photosensitive compositions. Preferred examples of dissolution inhibitors include those mentioned in paragraphs [0053] to [0055] of JP 2001-305722 A.

The thermal positive-type photosensitive compositions preferably also include, as additives, sensitivity regulators, print-out agents for obtaining a visible image immediately after heating from light exposure, compounds such as dyes as image colorants, and surfactants for enhancing coatability and treatment stability. Compounds such as those mentioned in paragraphs [0056] to [0060] of JP 2001-305722 A are preferred.

Use of the photosensitive compositions described in detail in JP 2001-305722 A is desirable for additional reasons as well.

The thermal positive-type image recording layer is not limited to a single layer, and may have a two-layer construction.

Preferred examples of image recording layers with a two-layer construction (also referred to as "multilayer-type image recording layers") include those of a type provided on the side close to the support with a bottom layer ("layer A") of excellent press life and solvent resistance, and provided on layer A with a layer ("layer B") having an excellent positive image-forming ability. This type of image recording layer has a high sensitivity and can provide a broad development latitude. Layer B generally contains a photothermal conversion substance. Preferred examples of the photothermal conversion substance include the dyes mentioned above.

Preferred examples of resins that may be used in layer A include polymers that include as a copolymerizable ingredient a monomer having a sulfonamide group, an active imino group or a phenolic hydroxyl group because such polymers have an excellent press life and solvent resistance. Preferred examples of resins that may be used in layer B include phenolic hydroxyl group-bearing resins which are soluble in alkali aqueous solutions.

In addition to the above resins, various additives may be included, if necessary, in the compositions used to form layers A and B. More specifically, various additives such as those mentioned in paragraphs [0062] to [0085] of JP 2002-323769 A may be suitably used. The additives mentioned in paragraphs [0053] to [0060] in JP 2001-305722 A may also be suitably used.

The components and proportions thereof in each of layers A and B may be selected as described in JP 11-218914 A.

Intermediate Layer

It is advantageous to provide an intermediate layer between the thermal positive-type image recording layer and the support. Preferred examples of ingredients that may be included in the intermediate layer include the various organic compounds mentioned in paragraph [0068] of JP 2001-305722 A.

Others

The processes described in JP 2001-305722 A may be used to form a thermal positive-type image recording layer and to manufacture a lithographic printing plate having such a layer.

Thermal Negative-Type Photosensitive Compositions

Thermal negative-type photosensitive compositions contain a curable compound and a photothermal conversion substance. A thermal negative-type image recording layer is a negative-acting photosensitive layer in which areas irradiated with light such as from an infrared laser cure, forming image areas.

Polymerizable Layer

One exemplary thermal negative-type image recording layer is a polymerizable image recording layer (polymerizable layer). The polymerizable layer contains a photothermal conversion substance, a radical generator, a radical polymerizable compound which is a curable compound, and a binder polymer. In the polymerizable layer, the photothermal conversion substance converts absorbed infrared light into heat, and the heat decomposes the radical generator, generating radicals. The generated radicals trigger the chain-like polymerization and curing of the radical polymerizable compound.

Illustrative examples of the photothermal conversion substance include photothermal conversion substances that may be used in the above-described thermal positive-type photosensitive composition. Specific examples of cyanine dyes which are especially preferred include those mentioned in paragraphs [0017] to [0019] of JP 2001-133969 A.

Preferred radical generators include onium salts. The onium salts mentioned in paragraphs [0030] to [0033] of JP 2001-133969 A are especially preferred.

Exemplary radical polymerizable compounds include compounds having one, and preferably two or more, terminal ethylenically unsaturated bonds.

Preferred binder polymers include linear organic polymers. Linear organic polymers which are soluble or swellable in water or a dilute alkali aqueous solution are preferred. Of these, (meth)acrylic resins having pendant unsaturated groups (e.g., allyl or acryloyl) or benzyl groups and pendant carboxyl groups are especially preferred because they provide an excellent balance of film strength, sensitivity and developability.

Radical polymerizable compounds and binder polymers that may be used include those mentioned specifically in paragraphs [0036] to [0060] of JP 2001-133969 A.

Thermal negative type photosensitive compositions preferably contain additives mentioned in paragraphs [0061] to [0068] of JP 2001-133969 A (e.g., surfactants for enhancing coatability).

The processes described in JP 2001-133969 A can be used to form a polymerizable layer and to manufacture a lithographic printing plate having such a layer.

Acid-Crosslinkable Image Recording Layer

Another preferred thermal negative-type image recording layer is an acid-crosslinkable image recording layer (abbreviated hereinafter as "acid-crosslinkable layer"). An acid-crosslinkable layer contains a photothermal conversion substance, a thermal acid generator, a compound (crosslinker) which is curable and which crosslinks under the influence of an acid, and an alkali-soluble polymeric compound which is capable of reacting with the crosslinker in the presence of an acid. In an acid-crosslinkable layer, the photothermal conversion substance converts absorbed infrared light into heat. The heat decomposes a thermal acid generator, thereby generating an acid which causes the crosslinker and the alkali-soluble polymeric compound to react and cure.

The photothermal conversion substance is exemplified by the same substances as can be used in a polymerizable layer.

Exemplary thermal acid generators include photopolymerization photoinitiators, dye photochromogenic substances, and heat-degradable compounds such as acid generators which are used in microresists.

Exemplary crosslinkers include hydroxymethyl or alkoxymethyl-substituted aromatic compounds, compounds having N-hydroxymethyl, N-alkoxymethyl or N-acyloxymethyl groups, and epoxy compounds.

Exemplary alkali-soluble polymeric compounds include novolak resins and polymers having pendant hydroxyaryl groups.

Photopolymer Type Photosensitive Compositions

Photopolymer-type photosensitive compositions contain an addition polymerizable compound, a photopolymerization initiator and a polymer binder.

Preferred addition polymerizable compounds include compounds having an addition-polymerizable ethylenically unsaturated bond. Ethylenically unsaturated bond-containing compounds are compounds which have a terminal ethylenically unsaturated bond. These include compounds having the chemical form of monomers, prepolymers, and mixtures thereof. The monomers are exemplified by esters of unsaturated carboxylic acids (e.g., acrylic acid, methacrylic acid, itaconic acid, maleic acid) and aliphatic polyols, and amides of unsaturated carboxylic acids and aliphatic polyamines.

Preferred addition polymerizable compounds include also urethane-type addition-polymerizable compounds.

The photopolymerization initiator may be any of various photopolymerization initiators or a system of two or more photopolymerization initiators (photoinitiation system) which is suitably selected according to the wavelength of the light source to be used. Preferred examples include the initiation systems mentioned in paragraphs [0021] to [0023] of JP 2001-22079 A.

The polymer binder, inasmuch as it must both function as a film-forming agent for the photopolymerizable photosensitive composition and must also allow the image recording layer to dissolve in an alkali developer, may be an organic polymer which is soluble or swellable in an aqueous alkali solution. Preferred examples of such organic polymers include those mentioned in paragraphs [0036] to [0063] of JP 2001-22079 A.

It is preferable for the photopolymer-type photopolymerizable photosensitive composition to contain the additives mentioned in paragraphs [0079] to [0088] of JP 2001-22079 A (e.g., surfactants for improving coatability, colorants, plasticizers, thermal polymerization inhibitors).

To prevent the inhibition of polymerization by oxygen, it is preferable to provide an oxygen-blocking protective layer on top of the photopolymer-type image recording layer. The polymer included in the oxygen-blocking protective layer is exemplified by polyvinyl alcohol and its copolymers thereof.

It is also desirable to provide an intermediate layer or a bonding layer like those described in paragraphs [0124] to [0165] of JP 2001-228608 A.

Conventional Negative Type Photosensitive Compositions

Conventional negative-type photosensitive compositions contain a diazo resin or a photo-crosslinkable resin. Of these, photosensitive compositions which contain a diazo resin and an alkali-soluble or swellable polymeric compound (binder) are preferred.

The diazo resin is exemplified by the condensation products of an aromatic diazonium salt with an active carbonyl group-bearing compound such as formaldehyde; and organic solvent-soluble diazo resin inorganic salts which are the reaction products of a hexafluorophosphate or tetrafluoroborate with the condensation product of a p-diazophenylamine and formaldehyde. The high-molecular-weight diazo compounds in which the content of hexamer and larger oligomers is at least 20 mol % mentioned in JP 59-78340 A are especially preferred.

Exemplary binders include copolymers containing acrylic acid, methacrylic acid, crotonic acid or maleic acid as an essential ingredient. Specific examples include the multi-component copolymers of monomers such as 2-hydroxyethyl (meth)acrylate, (meth)acrylonitrile and (meth)acrylic acid mentioned in JP 50-118802 A, and the multi-component copolymers of alkyl acrylates, (meth)acrylonitrile and unsaturated carboxylic acids mentioned in JP 56-4144 A.

Conventional negative-type photosensitive compositions preferably contain as additives the print-out agents, dyes, plasticizers for imparting flexibility and wear resistance to the applied coat, the compounds such as development promoters, and the surfactants for enhancing coatability mentioned in paragraphs [0014] to [0015] of JP 7-281425 A.

Below the conventional negative-type photosensitive layer, it is advantageous to provide the intermediate layer which contains a polymeric compound having an acid group-bearing component and an onium group-bearing component described in JP 2000-105462 A.

Conventional Positive-Type Photosensitive Compositions

Conventional positive-type photosensitive compositions contain a quinonediazide compound. Photosensitive compositions containing an o-quinonediazide compound and an alkali-soluble polymeric compound are especially preferred.

Illustrative examples of the o-quinonediazide compound include esters of 1,2-naphthoquinone-2-diazido-5-sulfonylchloride and a phenol-formaldehyde resin or a cresol-formaldehyde resin, and the esters of 1,2-naphthoquinone-2-diazido-5-sulfonylchloride and pyrogallol-acetone resins mentioned in U.S. Pat. No. 3,635,709.

Illustrative examples of the alkali-soluble polymeric compound include phenol-formaldehyde resins, cresol-formaldehyde resins, phenol-cresol-formaldehyde co-condensation resins, polyhydroxystyrene, N-(4-hydroxyphenyl)methacrylamide copolymers, the carboxyl group-bearing polymers mentioned in JP 7-36184 A, the phenolic hydroxyl group-bearing acrylic resins mentioned in JP 51-34711 A, the sulfonamide group-bearing acrylic resins mentioned in JP 2-866 A, and urethane resins.

Conventional positive-type photosensitive compositions preferably contain as additives the compounds such as sensitivity regulators, print-out agents and dyes mentioned in paragraphs [0024] to [0027] of JP 7-92660 A, and surfactants for enhancing coatability such as are mentioned in paragraph [0031] of JP 7-92660 A.

Below the conventional positive-type photosensitive layer, it is advantageous to provide an intermediate layer similar to the intermediate layer which is preferably used in the above-described conventional negative-type photosensitive layer.

Non-Treatment Type Photosensitive Compositions

Illustrative examples of non-treatment type photosensitive compositions include thermoplastic polymer powder-based photosensitive compositions, microcapsule-based photosensitive compositions, and sulfonic acid-generating polymer-containing photosensitive compositions. All of these are heat-sensitive compositions containing a photothermal conversion substance. The photothermal conversion substance is preferably a dye of the same type as those which can be used in the above-described thermal positive-type photosensitive compositions.

Thermoplastic polymer powder-based photosensitive compositions are composed of a hydrophobic, heat-meltable finely divided polymer dispersed in a hydrophilic polymer matrix. In the thermoplastic polymer powder-based image recording layer, the fine particles of hydrophobic polymer melt under the influence of heat generated by light exposure and mutually fuse, forming hydrophobic regions which serve as the image areas.

The finely divided polymer is preferably one in which the particles melt and fuse with other under the influence of heat. A finely divided polymer in which the individual particles have a hydrophilic surface, enabling them to disperse in a hydrophilic component such as dampening water is especially preferred. Preferred examples include the thermoplastic finely divided polymers described in Research Disclosure No. 33303 (January 1992), JP 9-123387 A, JP 9-131850 A, JP 9-171249 A, JP 9-171250 A and EP 931,647 A. Of these, polystyrene and polymethyl methacrylate are preferred. Illustrative examples of finely divided polymers having a hydrophilic surface include those in which the polymer itself is hydrophilic, and those in which the surfaces of the polymer particles have been rendered hydrophilic by adsorbing thereon a hydrophilic compound such as polyvinyl alcohol or polyethylene glycol.

The finely divided polymer preferably has reactive functional groups.

Preferred examples of microcapsule-type photosensitive compositions include those mentioned in JP 2000-118160 A, and compositions like those mentioned in JP 2001-277740 A in which a compound having thermally reactive functional groups is enclosed within microcapsules.

Illustrative examples of sulfonic acid-generating polymers that may be used in sulfonic acid generating polymer-containing photosensitive compositions include the polymers having pendant sulfonate ester groups, disulfone groups or sec- or tert-sulfonamide groups described in JP 10-282672 A.

Including a hydrophilic resin in a non-treatment type photosensitive composition not only provides a good on-press developability, it also enhances the film strength of the photosensitive layer itself. Preferred hydrophilic resins include resins having hydrophilic groups such as hydroxyl, carboxyl, hydroxyethyl, hydroxypropyl, amino, aminoethyl, aminopropyl or carboxymethyl groups; and hydrophilic sol-gel conversion-type binder resins.

The non-treatment type image recording layer can be developed on the press, and thus does not require a special development step. The processes described in JP 2002-178655 can be used as the method of forming a non-treatment type image recording layer and the associated platemaking and printing processes.

Back Coat

If necessary, the presensitized plate obtained by providing any of the various above image recording layers on a lithographic printing plate support obtained according to this invention may be provided on the back side with a coat composed of an organic polymeric compound to prevent scuffing of the image recording layer when the presensitized plates are stacked on top of each another.

Lithographic Platemaking Process

The presensitized plate prepared using a lithographic printing plate support obtained according to this invention is then rendered into a lithographic printing plate by any of various treatment methods, depending on the image recording layer.

Illustrative examples of sources of actinic light that may be used for imagewise exposure include mercury vapor lamps, metal halide lamps, xenon lamps and chemical lamps.

Examples of laser beams that may be used include helium-neon lasers, argon lasers, krypton lasers, helium-cadmium lasers, KrF excimer lasers, semiconductor lasers, YAG lasers and YAG-SHG lasers.

Following exposure as described above, when the image recording layer is of a thermal positive type, thermal negative type, conventional negative type, conventional positive type or photopolymer type, it is preferable to carry out development using a liquid developer in order to obtain the lithographic printing plate.

The liquid developer is preferably an alkali developer, and more preferably an alkaline aqueous solution which is substantially free of organic solvent.

Liquid developers which are substantially free of alkali metal silicates are also preferred. One example of a suitable method of development using a liquid developer that is substantially free of alkali metal silicates is the method described in detail in JP 11-109637 A.

Liquid developers which contain an alkali metal silicate can also be used.

EXAMPLES

Examples are given below by way of illustration and not by way of limitation.

1. Manufacture of Aluminum Sheet Embossing Roll

Examples 1-1 to 1-3, and Comparative Examples 1-1 and 1-2

In each example, a roll of tool steel (SKD11) that had been quenched and rendered to a hardness of Hv750 was successively subjected to treatments (1) to (5) below, yielding an aluminum sheet embossing roll.

(1) Mirror-Like Finishing

Buffing was carried out as the mirror-like finishing process, thereby removing marks left by the grindstone used to polish the surface of the roll.

(2) Blasting

The roll surface was administered graining treatment by air blasting it twice using a grit material composed of alumina particles having an average particle size of 100 μm. Each blast was carried out at an air pressure of 2 kgf/cm$^2$ ($1.96\times10^5$ Pa) and a blasting time of 2 seconds.

(3) Degreasing

The roll was immersed for 30 seconds in a degreasing tank containing a 30° C. degreasing solution, and surface oils were removed from the roll with the solution. The roll was then rinsed with water, following which air was blown over it to remove moisture.

(4) Electrolytic Treatment

The roll was subjected to electrolytic treatment in a 50° C. electrolyte solution containing 300 g/L of chromic acid, 2 g/L of sulfuric acid and 1 g/L of iron by the continuous application of a direct current at a current density of 30 A/dm$^2$ using the roll as the anode. The amount of electricity used in electrolytic treatment is shown in Table 1.

The current waveform was three-phase full-wave rectified, then passed through a filter circuit and used as direct current having a ripple component of 5% or less. Lead was used as the counterelectrode. The roll was placed upright in the electrolyte solution, and a cylindrical lead electrode was arranged so as to encircle it. The shaft portion of the roll was masked with vinyl chloride to keep it from undergoing electrolytic treatment.

(5) Chromium Plating

Next, chromium plating treatment was carried out in a 50° C. electrolyte solution containing 300 g/L of chromic acid, 2 g/L of sulfuric acid and 1 g/L of iron by the continuous application of a direct current at a current density of 40 A/dm$^2$ using the roll as the cathode. The plating treatment time was set such as to give a plating thickness of 6 μm.

The current waveform was three-phase full-wave rectified, then passed through a filter circuit and used as direct current having a ripple component of 5% or less. Lead was used as the counterelectrode. The roll was placed upright in the electrolyte solution, and a cylindrical lead electrode was arranged so as to encircle it. The shaft portion of the roll was masked with vinyl chloride to keep it from undergoing electrolytic treatment.

Example 1-4

Aside from carrying out the subsequently described mechanical polishing treatment (6) after the above-described blasting treatment (2) and before the degreasing treatment (3), an aluminum sheet embossing roll was obtained by the same method as in Example 1-2.

(6) Mechanical Polishing

The surface was re-abraded with #2000 sandpaper so as to grind down the locally high peaks that formed on the roll surface from blasting treatment to an average surface roughness $R_a$ of 0.6 μm. The average surface roughness $R_a$ was measured by the method described below.

2. Surface Shape of Aluminum Sheet Embossing Roll (1) Average Surface Roughness $R_a$, Maximum Height $R_y$, Mean spacing of profile irregularities Sm, and Average Slope Δa The roll obtained after polishing to a mirror-like finish, blasting, electrolytic treatment and chromium plating was then subjected to two-dimensional roughness measurement under the following conditions using a stylus-type roughness tester (Surfcom 575, available from Tokyo Seimitsu Co., Ltd.). The average surface roughness $R_a$ as defined by ISO 4287 was measured five times and the mean of these measurements was determined. The maximum height $R_y$, mean spacing of profile irregularities Sm and average slope Δa were similarly measured.

Measurement Conditions

Cutoff value, 0.8 mm; slope correction, FLAT-ML; measurement length, 3 mm; vertical magnification, 10,000×; scan rate, 0.3 mm/s; stylus tip diameter, 2 μm.

After being polished to a mirror-like finish, each roll had an average surface roughness $R_a$ of 0.2 μm and a maximum height $R_y$ at the surface of 1 μm.

After blasting treatment, the rolls had an average surface roughness $R_a$ of 0.9 μm.

Table 1 below shows the average surface roughness $R_a$, the maximum height $R_y$, the mean spacing of profile irregularities Sm, and the average slope Δa at the surface of the rolls following electrolytic treatment and chromium plating treatment.

TABLE 1

| | Mechanical polishing treatment | Amount of electricity in electrolytic treatment (C/dm$^2$) | After electrolytic treatment | | | | After chromium plating treatment | | | |
|---|---|---|---|---|---|---|---|---|---|---|
| | | | $R_a$ (μm) | $R_y$ (μm) | $S_m$ (μm) | Δa (°) | $R_a$ (μm) | $R_y$ (μm) | $S_m$ (μm) | Δa (°) |
| EX 1-1 | no | 3,500 | 1.1 | 10 | 80 | 13 | 0.9 | 7 | 90 | 8 |
| EX 1-2 | no | 6,000 | 1.2 | 10 | 75 | 14 | 1.0 | 8 | 80 | 9 |
| EX 1-3 | no | 8,500 | 1.3 | 12 | 85 | 15 | 1.2 | 9 | 95 | 11 |
| EX 1-4 | yes | 6,000 | 0.7 | 9 | 70 | 13 | 0.6 | 6 | 80 | 8 |
| CE 1-1 | no | 500 | 1.2 | 12 | 80 | 13 | 1.0 | 10 | 80 | 8 |
| CE 1-2 | no | 30,000 | 1.6 | 18 | 100 | 18 | 1.4 | 12 | 100 | 15 |

(2) Examination of Cross-Sectional Profile by Replica Technique

The surface of the aluminum sheet embossing roll obtained as described above was examined by the replica technique. Specifically, a replica was fabricated using a Technovit 3040 (available from Okenshoji Co., Ltd.). Replicas obtained in this way were used to measure the cross-sectional profiles of the aluminum sheet embossing rolls obtained in Example 1-2 and Comparative Example 1-1. The cross-sectional profiles were obtained by using a Micromap 520 (Ryoka Systems, Inc.) to measure recessed portions and protruded portions located on a cross-section in the lengthwise direction of the roll and record the profile on a chart. The results showed that the roll obtained in Example 1-2 had more uniform protruded portions at the surface than the roll obtained in Comparative Example 1-1.

3. Fabrication of Lithographic Printing Plate Support

Example 2-1

A melt was prepared from an aluminum alloy composed of 0.073 wt % silicon, 0.27 wt % iron, 0.1 wt % copper, 0.000 wt % manganese, 0.000 wt % magnesium, 0.001 wt % chromium, 0.003 wt % zinc and 0.002 wt % titanium, with the balance being aluminum and inadvertent impurities. The aluminum alloy melt was subjected to molten metal treatment and filtration, then was cast into a 500 mm thick, 1,200 mm wide ingot by a direct chill casting process. The ingot was scalped with a scalping machine, removing about 10 mm of material from the surface, then soaked and held at 550° C. for about 5 hours. When the temperature had fallen to 400° C., the ingot was rolled with a hot rolling mill to a sheet thickness of 2.7 mm. In addition, heat treatment was carried out at 500° C. in a continuous annealing furnace, following which cold rolling was carried out with the aluminum sheet embossing roll obtained in Example 1-1, thereby finishing the aluminum sheet to a thickness of 0.3 mm and a width of 1,060 mm.

The aluminum sheets obtained as described above were furnished to the surface treatment described below, thereby giving the lithographic printing plate supports.

Surface Treatment

The aluminum sheets were surface treated by successively carrying out each of the following treatments (a) to (j).

(a) Etching in Aqueous Alkali Solution

Etching was carried out by spraying the aluminum sheet with an aqueous solution having a sodium hydroxide concentration of 370 g/L, an aluminum ion concentration of 100 g/L and a temperature of 60° C. from a spray line. The amount of etching on the side of the aluminum sheet to be later administered electrochemical graining treatment was 3 g/m$^2$.

The solution was then removed from the sheet with nip rollers and the subsequently described rinsing treatment was carried out, following which the water used for rinsing was removed with nip rollers. Rinsing treatment consisted of rinsing the aluminum sheet with an apparatus that uses a free-falling curtain of water, and also directing fan-shaped sprays of water at the sheet for 5 seconds from spray tips mounted on spray lines.

(b) Desmutting

Desmutting was carried out by spraying a 35° C. aqueous nitric acid solution for 5 seconds from a spray line. Wastewater from the subsequently described electrochemical graining treatment step (c) carried out using an alternating current in an aqueous nitric acid solution was used here as the aqueous nitric acid solution.

The aluminum sheet was then carried away without removal of the solution from the sheet with nip rollers; that is, the aqueous nitric acid solution was left adhering to the sheet. The transport time to the next step was 25 seconds.

(c) Electrochemical Graining Treatment Using Alternating Current in Aqueous Nitric Acid (Nitric Acid Electrolysis)

An electrolyte solution having the same composition and temperature as the electrolyte solution used in the subsequently described nitric acid alternating current electrolysis was sprayed onto the aluminum sheet just prior to electrochemical graining treatment.

Electrochemical graining treatment was then immediately carried out using an electrolyte solution (solution temperature, 35° C.) prepared by dissolving aluminum nitrate in 10.4 g/L aqueous nitric acid to an aluminum ion concentration of 4.5 g/L and using 60 Hz AC voltage. The AC power supply waveform was the waveform shown in FIG. 2. The time Tp until the current reached a peak from zero was 1.2 ms, and the duty ratio (ta/T) was 0.5. A carbon electrode was used as the counterelectrode. Ferrite was used as the auxiliary anode. Two electrolytic cells of the type shown in FIG. 3 were used.

In electrochemical graining treatment, the current density during the anode reaction on the aluminum sheet at the alternating current peak was 60 A/dm$^2$. The ratio between the total amount of electricity used during the anode reaction on the aluminum sheet and the total amount of electricity used during the cathode reaction on the aluminum sheet was 0.95. The total amount of electricity used during the anode reaction on the aluminum sheet was 215 C/dm$^2$. Also, 5% of the current from the power supply was diverted to the auxiliary anode.

Next, the solution was removed from the aluminum sheet with nip rollers, following which rinsing was carried out by directing fan-like sprays of water at the sheet for 5 seconds from spray tips mounted on a spray line, then the water was removed with nip rollers.

(d) Etching in Aqueous Alkali Solution

Etching was carried out by spraying the aluminum sheet for 7 seconds from a spray line with an aqueous solution having a sodium hydroxide concentration of 370 g/L, an aluminum ion concentration of 100 g/L and a temperature of 64° C. The etching amount on the side of the aluminum sheet that had been administered electrochemical graining treatment was 3 $g/m^2$.

Next, the solution was removed from the aluminum sheet with nip rollers. Rinsing treatment was then carried out by rinsing the aluminum sheet using a rinsing apparatus that employs a free-falling curtain of water, and also directing fan-like sprays of water at the sheet for 5 seconds from spray tips mounted on spray lines. After rinsing, the rinse water was removed from the sheet with nip rollers.

(e) Desmutting

Desmutting was carried out by spraying the aluminum sheet for 10 seconds with an aqueous solution (solution temperature, 35° C.) prepared by dissolving aluminum nitrate in a 300 g/L aqueous nitric acid solution to an aluminum ion concentration of 2 g/L.

Next, the solution was removed from the aluminum sheet with nip rollers, rinsing treatment was carried out for 5 seconds using fan-like sprays of water directed at the aluminum sheet from spray tips mounted on spray lines, then the rinse water was removed from the sheet with nip rollers.

(f) Electrochemical Graining Treatment Using Alternating Current in Aqueous Hydrochloric Acid Solution (Hydrochloric Acid Electrolysis)

Electrochemical graining treatment was then successively carried out using an electrolyte solution (solution temperature, 35° C.) prepared by dissolving aluminum chloride in a 5 g/L aqueous hydrochloric acid solution to an aluminum ion concentration of 5 g/L and using 60 Hz AC voltage. The AC power supply waveform was the waveform shown in FIG. 2. The time Tp until the current reached a peak from zero was 0.8 ms, and the duty ratio (ta/T) was 0.5. A carbon electrode was used as the counterelectrode. Ferrite was used as the auxiliary anode. One electrolytic cell of the type shown in FIG. 3 was used.

In electrochemical graining treatment, the current density during the anode reaction on the aluminum sheet at the alternating current peaks was 50 $A/dm^2$. The ratio between the total amount of electricity used during the anode reaction on the aluminum sheet and the total amount of electricity used during the cathode reaction on the aluminum sheet was 0.95. The total amount of electricity during the anode reaction on the aluminum sheet was 65 $C/dm^2$. Also, 5% of the current from the power supply was diverted to the auxiliary anode. The relative speed between the aluminum sheet and the electrolyte solution averaged 1.5 m/s within the electrolytic cell.

Next, the solution was removed from the aluminum sheet with nip rollers, following which rinsing was carried out by directing fan-like sprays of water for 5 seconds at the sheet from spray tips mounted on a spray line, then the water was removed with nip rollers.

(g) Etching in Aqueous Alkali Solution

Etching was carried out by spraying the aluminum sheet from a spray line with an aqueous solution having a sodium hydroxide concentration of 50 g/L, an aluminum ion concentration of 5 g/L and a temperature of 35° C. The amount of etching on the side of the aluminum sheet that was administered electrochemical graining treatment was 0.2 $g/m^2$.

Next, the solution was removed from the aluminum sheet with nip rollers. Rinsing treatment to be described later was then carried out by rinsing the aluminum sheet using a rinsing apparatus that employs a free-falling curtain of water, and also directing fan-like sprays of water at the sheet for 5 seconds from spray tips mounted on spray lines. After rinsing, the rinse water was removed from the sheet with nip rollers.

(h) Desmutting

Desmutting was carried out by spraying the aluminum sheet for 5 seconds with an aqueous solution (solution temperature, 35° C. ) having a sulfuric acid concentration of 170 g/L and an aluminum ion concentration of 5 g/L. Wastewater from the subsequently described anodizing treatment step (i) was used as the aqueous solution.

The solution was then removed from the aluminum sheet with nip rollers, but the sheet was not rinsed with water.

(i) Anodizing Treatment

Anodizing treatment was carried out with an anodizing apparatus.

The electrolyte solution used in this step was prepared by dissolving aluminum sulfate in a 170 g/L aqueous sulfuric acid solution to an aluminum ion concentration of 5 g/L, and had a temperature of 33° C. Anodizing treatment was carried out in such a way that the average current density on the aluminum sheet during the anode reaction was 15 $A/dm^2$. The final weight of the anodized layer was 2.4 $g/m^2$.

Next, the solution was removed from the aluminum sheet with nip rollers. Rinsing treatment was then carried out for 5 seconds using fan-like sprays of water directed at the sheet from spray tips mounted on spray lines, and the rinse water was removed from the sheet with nip rollers.

(j) Hydrophilizing Treatment

Hydrophilizing treatment was carried out by immersing the aluminum sheet for 10 seconds in a 1 wt % solution of sodium silicate in water (solution temperature, 20° C.). The amount of silicon on the surface of the aluminum sheet, as measured by a fluorescent x-ray analyzer, was 3.5 $mg/m^2$.

Next, the solution was removed from the sheet with nip rollers. Rinsing treatment was then carried out for 5 seconds using fan-like sprays of water directed at the sheet from spray tips mounted on spray lines, and the rinse water was removed from the sheet with nip rollers.

The sheet was then dried by blowing 90° C. air across it for 10 seconds, thereby giving a lithographic printing plate support.

Example 2-2

Aside from using the aluminum sheet embossing roll obtained in Example 1-2 instead of the aluminum sheet embossing roll obtained in Example 1-1, a lithographic printing plate support was obtained in the same way as in Example 2-1.

Example 2-3

Aside from using the aluminum sheet embossing roll obtained in Example 1-3 instead of the aluminum sheet embossing roll obtained in Example 1-1, a lithographic printing plate support was obtained in the same way as in Example 2-1.

Example 2-4

Aside from using the aluminum sheet embossing roll obtained in Example 1-4 instead of the aluminum sheet embossing roll obtained in Example 1-1, a lithographic printing plate support was obtained in the same way as in Example 2-1.

Example 2-5

Aside from carrying out treatment step (k) described below between above treatment steps (i) and (j), a lithographic printing plate support was obtained in the same way as in Example 2-2.

(k) Sealing

Sealing was carried out by immersing the aluminum sheet for 10 seconds in an aqueous solution (solution temperature, 60° C.) containing 0.2 wt % of sodium hexafluorozirconate and 0.2 wt % of sodium dihydrogenphosphate.

Next, the solution was removed from the sheet with nip rollers. Rinsing treatment was then carried out for 5 seconds using fan-like sprays of water directed at the sheet from spray tips mounted on spray lines, and the rinse water was removed from the sheet with nip rollers.

Comparative Example 2-1

Aside from using the aluminum sheet embossing roll obtained in Comparative Example 1-1 instead of the aluminum sheet embossing roll obtained in Example 1-1, a lithographic printing plate support was obtained in the same way as in Example 2-1.

Comparative Example 2-2

Aside from using the aluminum sheet embossing roll obtained in Comparative Example 1-2 instead of the aluminum sheet embossing roll obtained in Example 1-1, a lithographic printing plate support was obtained in the same way as in Example 2-1.

4. Surface Shape of Aluminum Sheet

In Example 2-2, the aluminum sheet obtained using the aluminum sheet embossing roll of Example 1-2 (that is, the aluminum sheet prior to administering above treatment (a)) was subjected to measurements of average surface roughness $R_a$, maximum height $R_y$, mean spacing of profile irregularities Sm, and average slope Δa by the same methods as those used on the aluminum sheet embossing roll.

The average surface roughness $R_a$ was 0.65 μm, the maximum height $R_y$ was 5.7 μm, the mean spacing of profile irregularities Sm was 70 μm, and the average slope Δa was 7.5°.

5. Surface Examination of Lithographic Printing Plate Supports

The surfaces of each of the lithographic printing plate supports obtained in Examples 2-1 to 2-5 were examined under a scanning electron microscope (JSM-5500, manufactured by JEOL, Ltd.; the same applies below) at a magnification of 50,000×, whereupon micropits about 0.1 μm diameter were found to have uniformly and densely formed on the surface.

Scanning electron microscope examination of the support surface at a magnification of 2,000× showed that 1 to 5 μm diameter pits had uniformly formed on the surface.

It should be noted that the micropits of about 0.1 μm diameter were superimposed on the 1 to 5 μm diameter pits.

6. Fabrication of Presensitized Plate

Presensitized plates for lithographic printing were fabricated by providing a thermal positive-working image recording layer in the manner described below on the respective lithographic printing plate supports obtained above. Before providing the image recording layer, an undercoat was formed on the support as follows.

An undercoating solution of the composition indicated below was applied onto the lithographic printing plate support and dried at 80° C. for 15 seconds, thereby forming an undercoat layer. The weight of the undercoat layer after drying was 15 mg/$M^2$.

| Composition of Undercoating Solution | |
|---|---|
| Polymeric compound of the following formula | 0.3 g |

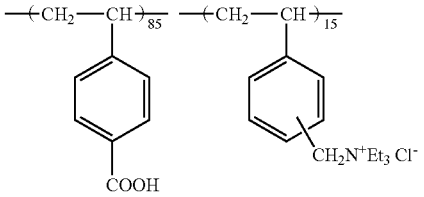

(molecular weight, 28,000

| | |
|---|---|
| Methanol | 100 g |
| Water | 1 g |

In addition, a heat-sensitive layer-forming coating solution of the following composition was prepared. The heat-sensitive layer-forming coating solution was applied onto the undercoated lithographic printing plate support to a coating weight when dry (heat-sensitive layer coating weight) of 1.8 g/$m^2$ and dried so as to form a heat-sensitive layer (thermal positive-type image recording layer), thereby giving a presensitized plate.

| Composition of Heat Sensitive Layer-Forming Coating Solution | |
|---|---|
| Novolak resin (m-cresol/p-cresol = 60/40; weight-average molecular weight, 7,000; unreacted cresol content, 0.5 wt %) | 0.90 g |
| Ethyl methacrylate/isobutyl methacrylate/meethacrylic acid copolymer (molar ratio, 35/35/30) | 0.10 g |

-continued

| Composition of Heat Sensitive Layer-Forming Coating Solution | |
|---|---|
| Cyanine dye A of the following formula | 0.1 g |

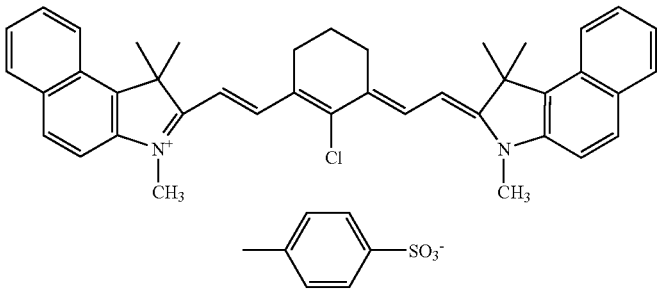

Cyanine Dye A

| | |
|---|---|
| Tetrahydrophthalic anhydride | 0.05 g |
| p-Toluenesulfonic acid | 0.002 g |
| Ethyl violet in which counterion was changed to 6-hydroxy-β-naphthalenesulfonic acid | 0.02 g |
| Fluorocarbon surfactant (Defensa F-780F, available from Dainippon Ink & Chemicals; 30 wt % solids) (solids) | 0.0045 g |
| Fluorocarbon surfactant (Defensa F-780F, available from Dainippon Ink & Chemicals; 100 wt % solids) | 0.035 g |
| Methyl ethyl ketone | 12 g |

7. Evaluation of Presensitized Plates

The resulting presensitized plates were evaluated for sensitivity, press life (number of impressions), scumming resistance and resistance to ink fill-in.

The presensitized plates obtained using the lithographic printing plate supports from Examples 2-1 to 2-3 had an excellent sensitivity, press life, scumming resistance and resistance to ink fill-in.

The presensitized plates obtained using the lithographic printing plate supports from Examples 2-4 and 2-5 had about the same degree of press life, scumming resistance and resistance to ink fill-in as in Examples 2-1 to 2-3, but had an even better sensitivity.

By contrast, the presensitized plates obtained using the lithographic printing plate supports from Comparative Examples 2-1 and 2-2 had about the same degree of scumming resistance and resistance to ink fill-in as in Examples 2-1 to 2-3, but had an inferior sensitivity and press life.

What is claimed is:

1. A method of manufacturing supports for lithographic printing plates, comprising:

subjecting a surface of a steel roll to at least the steps of, in order: blasting treatment, electrolytic treatment with 1,000 to 20,000 C/dm$^2$ of electricity in which the steel roll is used as the anode, and chromium plating treatment, such that the surface of the roll has a maximum height Ry of 5 to 25 μm, and an average slope Δa of 5 to 25°; and transferring recessed portions and protruded portions to a surface of an aluminum sheet with the roll, wherein the roll prior to the electrolytic treatment has a mean surface roughness Ra of 0.3 to 1.5 μm, and the roll after the electrolytic treatment has a mean surface roughness Ra of 0.5 to 2.0 μm and a mean spacing for profile irregularities Sm of 10 to 200 μm.

2. The method according to claim 1, wherein protruded portions that have formed on the surface of the roll as a result of the blasting treatment are mechanically polished after the blasting treatment but before the electrolytic treatment.

3. The method according to claim 2, wherein the roll prior to the blasting treatment has a surface that has been polished to a mirror finish.

4. The method according to claim 1, wherein the roll prior to the blasting treatment has a surface that has been polished to a mirror finish.

* * * * *